US012263980B2

(12) United States Patent
Mondini et al.

(10) Patent No.: US 12,263,980 B2
(45) Date of Patent: Apr. 1, 2025

(54) APPARATUS FOR THE APPLICATION OF A FILM TO A SUPPORT

(71) Applicant: G.MONDINI S.P.A., Cologne (IT)

(72) Inventors: Giovanni Mondini, Cologne (IT); Paolo Carlo Mondini, Cologne (IT)

(73) Assignee: G.MONDINI S.P.A., Cologne (IT)

( * ) Notice: Subject to any disclaimer, the term of this patent is extended or adjusted under 35 U.S.C. 154(b) by 84 days.

(21) Appl. No.: 18/319,682

(22) Filed: May 18, 2023

(65) Prior Publication Data

US 2023/0406556 A1 Dec. 21, 2023

(30) Foreign Application Priority Data

May 20, 2022 (EP) ..... 22174692
Apr. 20, 2023 (EP) ..... 23169057

(51) Int. Cl.
*B65B 31/02* (2006.01)
*B65B 7/16* (2006.01)

(52) U.S. Cl.
CPC ..... *B65B 7/164* (2013.01); *B65B 7/165* (2013.01)

(58) Field of Classification Search
CPC ..... B65B 31/028; B65B 7/164; B65B 7/162; B65B 7/165; B65B 9/04; B29C 51/165; B29C 66/849
See application file for complete search history.

(56) References Cited

U.S. PATENT DOCUMENTS 4,200,481 A * 4/1980 Faller ..... B29C 51/165 156/499
4,257,530 A * 3/1981 Faller ..... B65B 9/04 229/905

(Continued)

FOREIGN PATENT DOCUMENTS

DE 102016111357 A1 * 12/2017 ..... B65B 43/44
ES 2013908 A6 6/1990
IT 201900010938 A1 1/2021

OTHER PUBLICATIONS

European Search Report from European Application No. 22174692.8, Report Completed Mar. 1, 2023, 10 pages.

*Primary Examiner* — Andrew M Tecco
(74) *Attorney, Agent, or Firm* — Chrisman Gallo Tochtrop LLC

(57) ABSTRACT

An apparatus for application of a film (2) to a support (3), comprising: a movement path with an application station (6); a movement element (13) slidable along the movement path; a supporting element (14) coupled to and movable with the movement element (13) which defines a housing (23) for the support (3); an application device (4) in the application station (6) for applying the film (2) to the support (3) when the supporting element (14) is in the station. The application device (4) comprises a closing element (32), a contact element (33) and the supporting element (14) in the application station (6) interposed between them. When the supporting element (14) is in the application station (6), the closing element (32) and the supporting element are movable between an opening position, in which they are uncoupled and spaced apart from each other, and a closing position, in which they are coupled to apply the film (2) to the support (3). The contact element (33) supports the supporting element (14) when the supporting element and the closing element (32) are in the closing position.

27 Claims, 28 Drawing Sheets

(56) References Cited

U.S. PATENT DOCUMENTS

| | | | | |
|---|---|---|---|---|
| 9,272,797 | B2 * | 3/2016 | Praesenz | B65B 7/164 |
| 2012/0279171 | A1 * | 11/2012 | Praesenz | B65B 59/04<br>279/4.04 |

* cited by examiner

APPARATUS FOR THE APPLICATION OF A FILM TO A SUPPORT

This invention relates to an apparatus for application of a film to a support. In particular, this apparatus relates to an apparatus for application of a film to a support, where the support is configured to constitute a part of a pack for packaging a product. Preferably, this invention is applied in the food sector, being intended for packaging any type of food products (for example, fresh food products such as meat and cheeses). However, this invention may also be applied in sectors different from the food sector, therefore being intended for packaging any type of product.

This invention is applied both in apparatuses in which the film is used to close and/or seal a support, for example a tray, on which a product to be packaged is present, and in apparatuses in which the film is used as a liner for making trays or the like, by means of thermoforming of the film on a support, or gluing of the film on a support, intended to act as a supporting skeleton.

In general, prior art apparatuses of these types comprise an application device of which a movable mould intended to move the support before and after film application is a part. Each mould is movable along a movement path, relative to the rest of the application device, and defines a housing for receiving the support. The application device is configured to apply the film to the support when the mould is located at an application station in which the other parts of the application device are positioned.

In the prior art there are apparatuses which comprise multiple moulds which are moved along the movement path. In these apparatuses, the moulds are spaced apart from each other and are movable together with each other as one. The distance between the moulds therefore remains constant during the entire movement of the moulds. In some of these apparatuses, the moulds are coupled (for example, they are fixed) to a movement device which defines the movement path. For example, in some of these apparatuses the movement device comprises two parallel chains which move synchronised with each other along a looped path and on which the moulds are fixed.

These apparatuses are generally suitable for applying the film to a single type of support and are therefore characterised both by low versatility and by poor operating flexibility.

In general, the use is known of guides with linear motors even for movement of the moulds of the type described above between various processing stations. That involves significant advantages compared with traditional apparatuses, in which the moulds are placed at fixed distances and move together with each other as one, since a more versatile apparatus is obtained with greater operating flexibility (in particular, in the case in which along the movement path further processing stations are present, such as for example stations for feeding the support to the mould).

However, the potentially advantageous aspects of the use of guides with linear motors, linked to their versatility and operating flexibility, are nullified by several disadvantages.

In fact it is known that the presence of guides with linear motors does not allow application of the film to the support without picking up either the supports from the moulds or the entire moulds from the guide with linear motors (depending on the configuration of the apparatus) and feeding them to a specific application device. Therefore, in order to apply the film to the support it is necessary to pick up each support from the respective mould, or each mould from the guide with linear motors, and to position it at the application device. Following application, it is also usually necessary to reposition the support (with the film) at the mould, or the mould (which houses the support with the film) at the guide with linear motors, in order to be able to move the mould, which houses the support with the film applied, towards the next processing station (for example, towards a station for sorting, boxing or stacking the supports).

The above involves, first, the need to have a station for picking up the support from the mould, or the mould from the guide with linear motors (and if necessary a station for re-inserting the support in the mould or the mould on the guide with linear motors) and, second, relatively long production times due to the pick-up step. Both of these factors translate into a limitation of productivity and an increase in production costs.

The disadvantage described above is very much felt both if the application device is a sealing machine (for example, a modified atmosphere sealing machine, a sealing machine for Skin packaging, or a vacuum sealing machine) or a closing machine for packaging a product, or if the application device is a thermoforming machine for application of a liner (the film) to a support of any type (to then be used as part of a pack).

In this context the technical purpose which forms the basis of this invention is to provide an apparatus for application of a film to a support which overcomes the above-mentioned disadvantages.

In particular the technical purpose of this invention is to provide an apparatus for application of a film to a support which allows an increase in productivity and a reduction in production costs compared with prior art apparatuses.

The technical purpose specified and the aims indicated are substantially achieved by an apparatus for application of a film to a support, as described in the independent claim. Particular embodiments of this invention are defined in the corresponding dependent claims.

Further features and the advantages of this invention will be more apparent from the detailed description of several preferred, non-limiting embodiments of an apparatus for application of a film to a support, illustrated in the accompanying drawings, in which.

Figure 1:
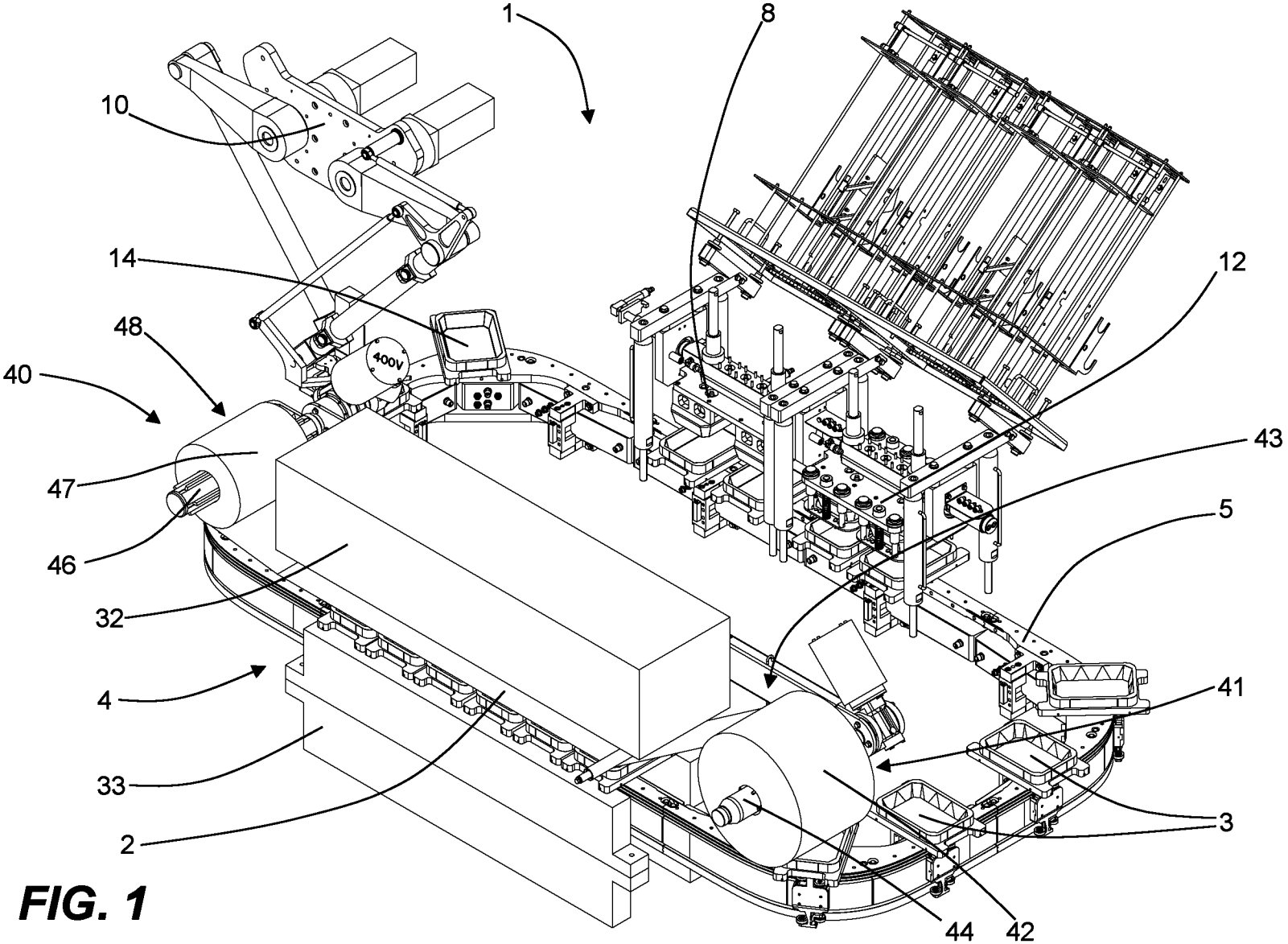
FIG. 1 is axonometric view of an embodiment of an apparatus for application of a film to a support according to this invention.

Hereinafter, with reference to the above-mentioned figures, the reference number 1 denotes in its entirety an apparatus for application of a film 2 to a support 3 according to this invention.

According to this invention, the support 3 is configured to constitute a part of a pack for packaging a product. It should be emphasised that, although this invention is advantageously applied in the case in which the product is a food product, that shall not be understood to be limiting; in fact it is possible that the support 3 may be configured to constitute a part of a pack for packaging a non-food product, such as for example a cleaning product. In the accompanying figures, the pack and the product are not shown.

This invention is applied in two different types of apparatuses 1: a first type, in which the film 2 is used to close and/or to seal the support 3 on which the product to be packaged is present, and a second type, in which the film 2 is used to make a tray by means of thermoforming of the film 2 on the support 3 or gluing of the film 2 on the support 3.

With reference to the support 3 in the case of apparatuses 1 of the first type, hereinafter in the description reference will be made to it using the term "tray": this term will mean generically a support 3 which is intended to receive a product to be packaged and which is suitable for being closed and/or sealed with the film 2. With reference to the support 3 in the case of apparatuses 1 of the second type, in contrast, hereinafter in the description reference will be made to it with the term "skeleton": this term will mean generically a support 3 which is suitable for making a tray by thermoforming, or gluing, of the film 2 on the support 3.

According to this invention, the apparatus 1 comprises an application device 4 (whose main characteristics will be described in detail below) for applying the film 2 to the support 3.

In particular, an apparatus 1 of the first type advantageously comprises an application device 4 selected from a group which comprises a modified atmosphere sealing machine, a vacuum sealing machine, a skin packaging machine and a closing machine. Hereinafter in the description, except when directly referring to some of the machines listed above, reference will be made to them generally with the term "closer". In contrast, an apparatus 1 of the second type comprises an application device 4 which may correspond to a thermoforming machine for thermoforming the film 2 on the support 3 or to a machine for gluing the film 2 on the support 3 (for example in the case of a flat support 3). Hereinafter in the description reference will be made to them simply with the term "thermoformer".

According to this invention, in the case in which the apparatus 1 is configured to apply the film 2 to a tray (apparatus 1 of the first type), the tray may be made of any material suitable for the purpose. In some embodiments, the tray may be constituted of materials comprising, in general, cellulose and/or vegetable fibres. For example, the tray may be constituted of cardboard and/or of cellulose moulded fibre. In other embodiments, the tray may be constituted of different materials, for example the tray may be constituted of a plastic material-based article or of a metal material-based article (such as, for example, aluminium). Embodiments are also possible in which the tray is constituted of an article based on a plurality of different materials (such as, for example, both plastic material and cellulose material).

Finally, it is possible that the tray is of the type obtainable with an apparatus 1 of the second type to which this patent application refers.

Moreover, this invention is not limited by aesthetic aspects of the tray, since it may be coloured, transparent, printed, with text, etc., or by the shape of the tray, since it may have a tub shape, it may be flat, etc. For example, whether the tray is flat (that is to say, the tray extends substantially in a lying plane) or the tray is substantially tub-shaped (that is to say, the tray has a concavity inside which the product to be packaged can advantageously be received and housed), the film 2 can be coupled to the tray by gluing of the film 2 to the tray.

Moreover, the tray may comprise a single sheet, folded and/or shaped and/or glued on itself, or the tray may comprise two or more sheets which are folded and/or shaped and/or glued and/or constrained to each other.

Moreover, again with reference to apparatuses 1 of the first type, even the film 2 may be of any type suitable for being applied to the tray. In particular, the film 2 may advantageously be a deformable film 2 (for example, if the closer is the vacuum sealing machine or the skin packaging machine), advantageously deformable by means of heating of the film 2 itself. However, it is possible that the film 2 is a non-deformable film 2 (for example, if the closer is either the machine for sealing in a controlled atmosphere or the actual closing machine).

Moreover, the film 2 may be made of any material, depending on the type of closer. In some embodiments, in which the closer is the vacuum sealing machine, the skin packaging machine or the sealing machine for packaging in a modified atmosphere, the film 2 is a plastic film 2 which is impermeable to air. In some embodiments, the film 2 may comprise a fossil-based plastic material or a bio-based plastic material.

Embodiments are also possible in which the closer is the actual closing machine, in which it may not be necessary to guarantee a seal between the inside and the outside of the pack. In these embodiments the film 2 may comprise, or be constituted of, a material which is permeable to air. For example, the film 2 comprises, or is constituted of, a paper and cardboard industry material; it is also possible that the film 2 has holes, which put the inside of the pack in communication with the outside.

In yet other embodiments, the film 2 comprises, or is constituted of, different materials, such as for example a metal material (such as for example aluminium).

Even if the apparatus 1 is configured to apply the film 2 to a skeleton by thermoforming of the film 2 on the skeleton or by gluing of the film 2 to the skeleton (apparatus 1 of the second type), this invention is not limited by aesthetic aspects of the skeleton, since it may be coloured, transparent, printed, with text, etc. as described above.

Moreover, in these embodiments, the skeleton may be a skeleton which is already formed or a skeleton to be formed.

If the skeleton is already formed, it may advantageously have a tub shape or a flat shape and it may be made of any material suitable for the purpose. In some embodiments, the skeleton may be constituted of materials comprising, in general, cellulose and/or vegetable fibres. For example, the skeleton may be constituted of cardboard and/or of cellulose moulded fibre. In other embodiments, the skeleton may be constituted of different materials, for example the skeleton may be constituted of a plastic material-based article or of a metal material-based article (such as, for example, aluminium). Embodiments are also possible in which the skeleton is constituted of an article based on a plurality of different materials (such as, for example, both plastic material and cellulose material). Moreover, the skeleton may be constituted of a single sheet, folded and/or shaped and/or glued on itself, or the skeleton may be constituted of two or more sheets which are folded and/or shaped and/or glued and/or constrained to each other.

In contrast, if the skeleton is a skeleton to be formed, at least before being formed it advantageously has a flat shape. Moreover it may be constituted of any material indicated above or of any thermoformable plastic material. Moreover, the skeleton may either be constituted of a single sheet, or may be constituted of two or more coupled sheets.

Both in the case in which the skeleton is an already formed skeleton, and in the case in which the skeleton is a skeleton to be formed, the film 2 may advantageously be a thermoformable film 2. For example the thermoformable film 2 comprises, or is constituted of, a material suitable for constituting a liner. More particularly, it is possible that the material suitable for constituting the liner may advantageously constitute a barrier layer to oxygen (for example, the liner may comprise a layer of EVOH). Moreover, as already indicated, the film 2 is a plastic film 2. For example, the film 2 may comprise a fossil-based plastic material or a bio-based plastic material.

In any case, the specific characteristics of the support 3 (both regarding the tray, and regarding the skeleton) and the characteristics of the film 2, should not be understood to be either important or limiting for this invention, an expert in the sector will be capable on each occasion of selecting the type of support 3 and the type of film 2 (based on their characteristics described above) best suited to his or her needs.

Hereinafter, for ease of description, reference will mainly be made to a support 3 which comprises a bottom wall, which is usually configured to receive the product, a plurality of lateral walls, which advantageously extend upwards starting from the lateral walls, and a flange, connected to the top of the lateral walls.

Moving on to a description of the apparatus 1 according to this invention, first it comprises a movement path with which an application station 6 is associated.

In some preferred embodiments (to which the accompanying figures refer) the apparatus 1 according to this invention comprises a guide 5, constituted of a guide with linear motors, which defines the movement path. In contrast, in other embodiments, the guide 5 may be constituted of a guide with planar motor which defines the movement path. It should be emphasised that the aspects strictly linked to operation of the guide 5 with linear motors and of the guide with planar motor, in particular operation of the linear motors or of the planar motor, are aspects which are in themselves known to a person who is expert in the sector and will not be explained in further detail in the following description.

In other embodiments the movement path may be defined by a different type of conveyor, for example a chain conveyor.

Figure 4:
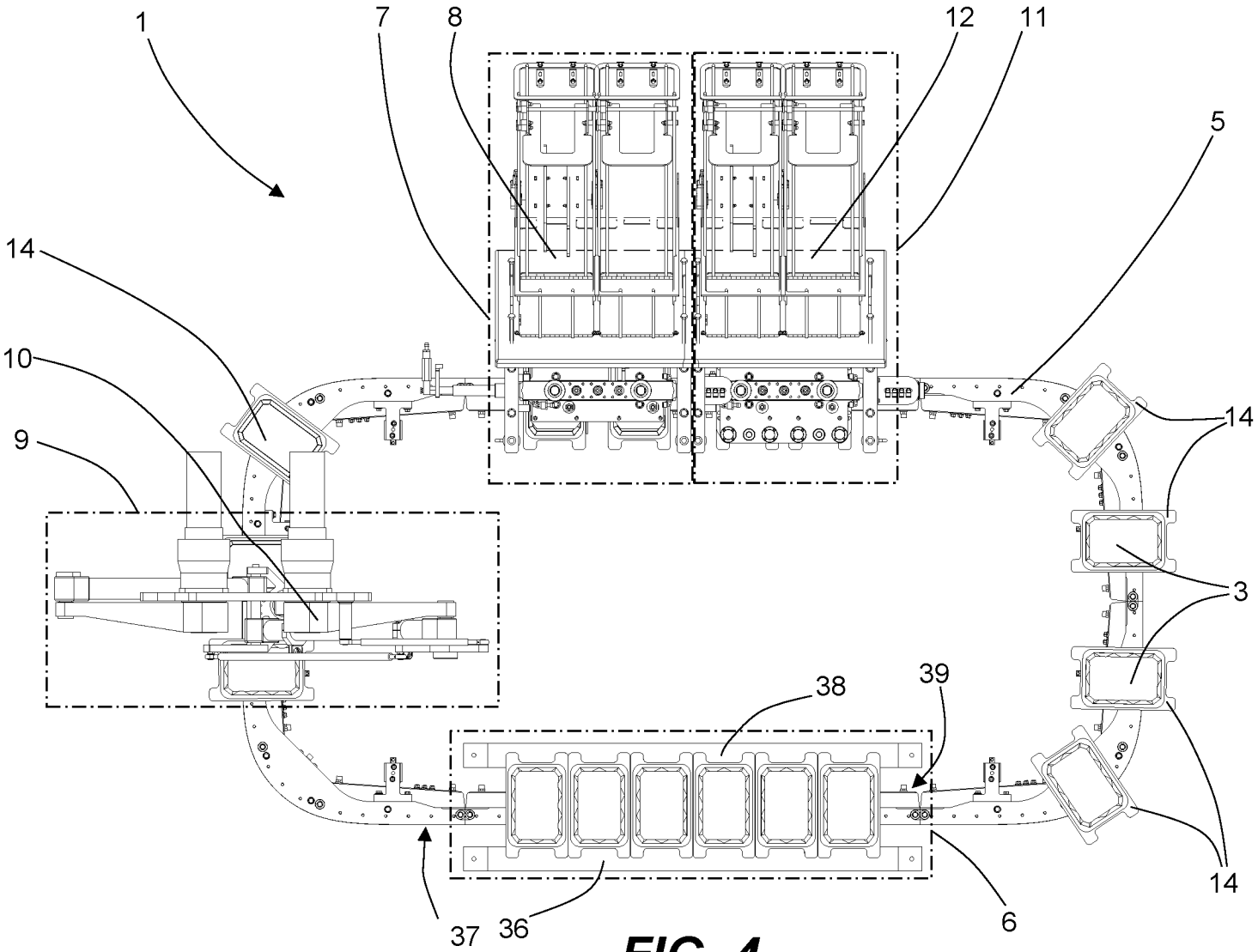
FIG. 4 is a top view of the apparatus of FIG. 3.
Figure 5:
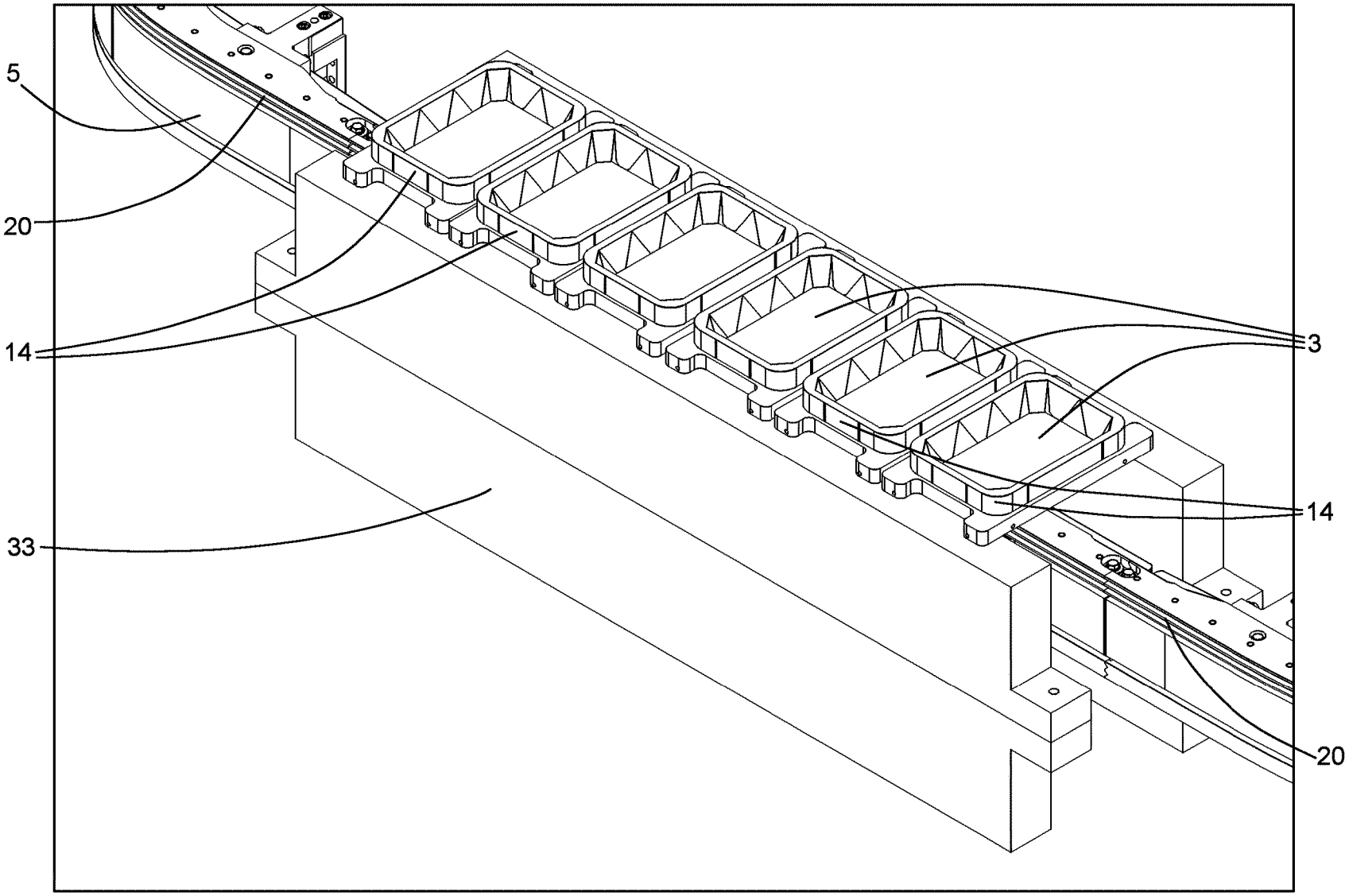
FIG. 5 is an enlarged view of the detail V of FIG. 3.
Figure 6:
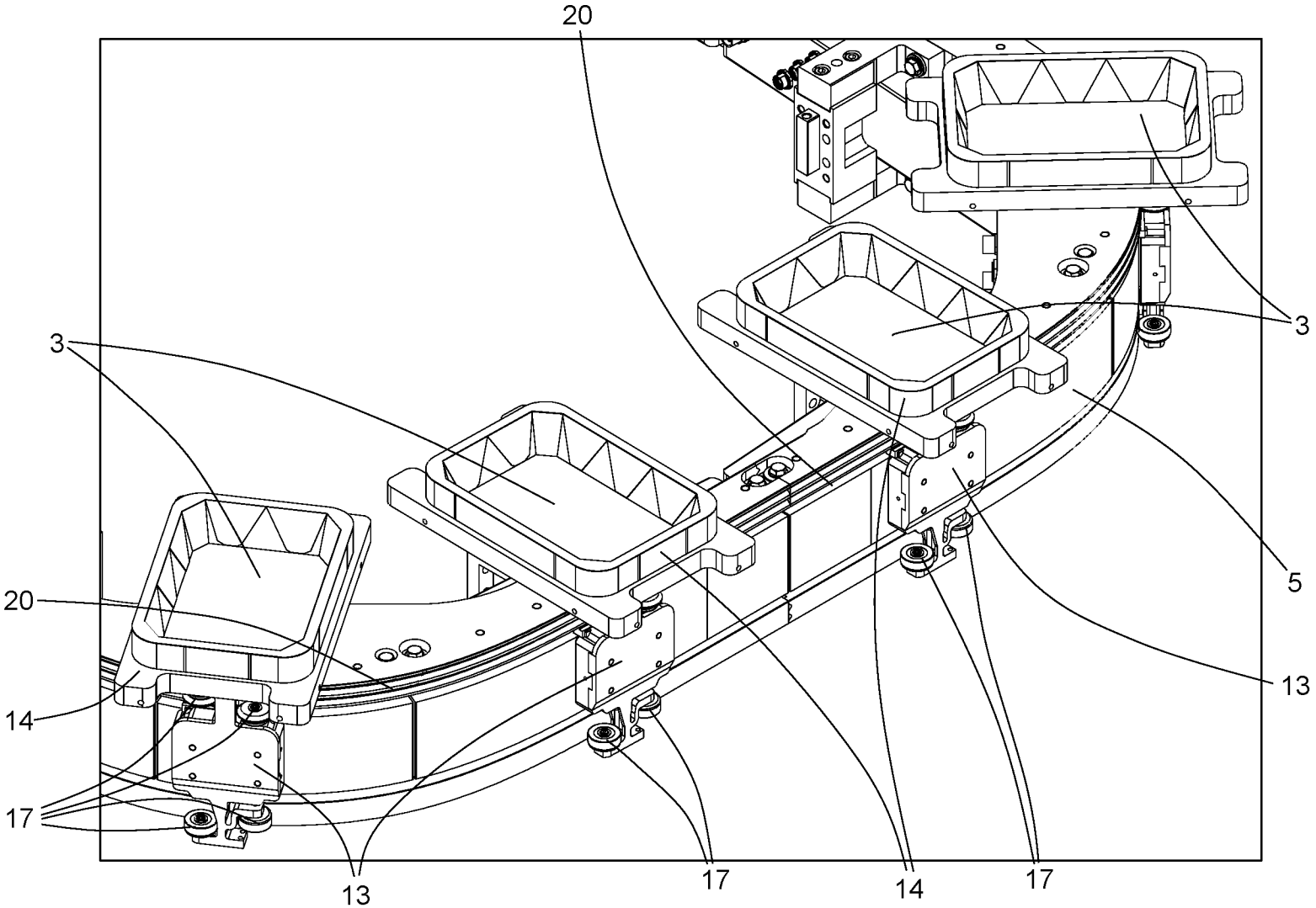
FIG. 6 is an enlarged view of the detail VI of FIG. 3.
Figure 8:
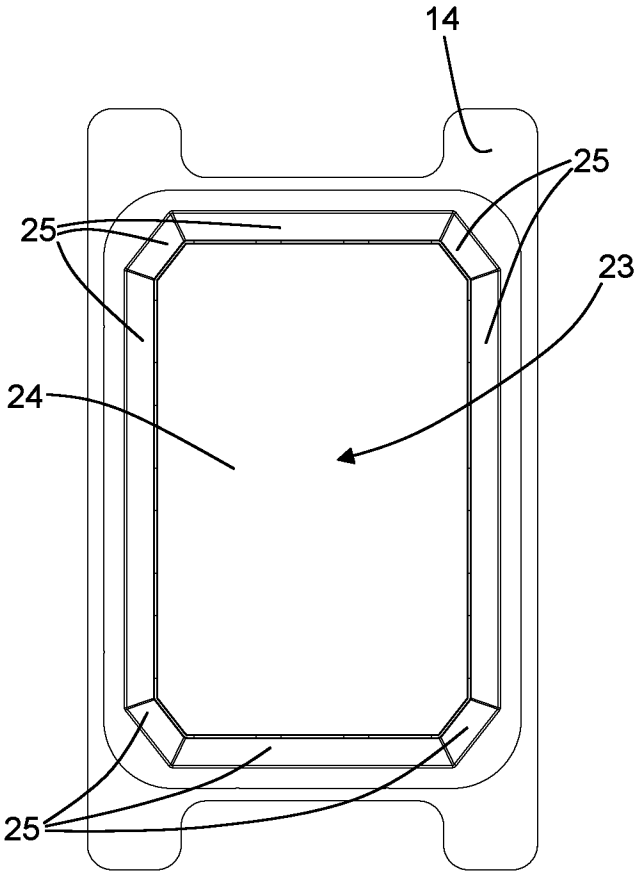
FIG. 8 is a top view of the supporting element and the movement element of FIG. 7.
Figure 7:
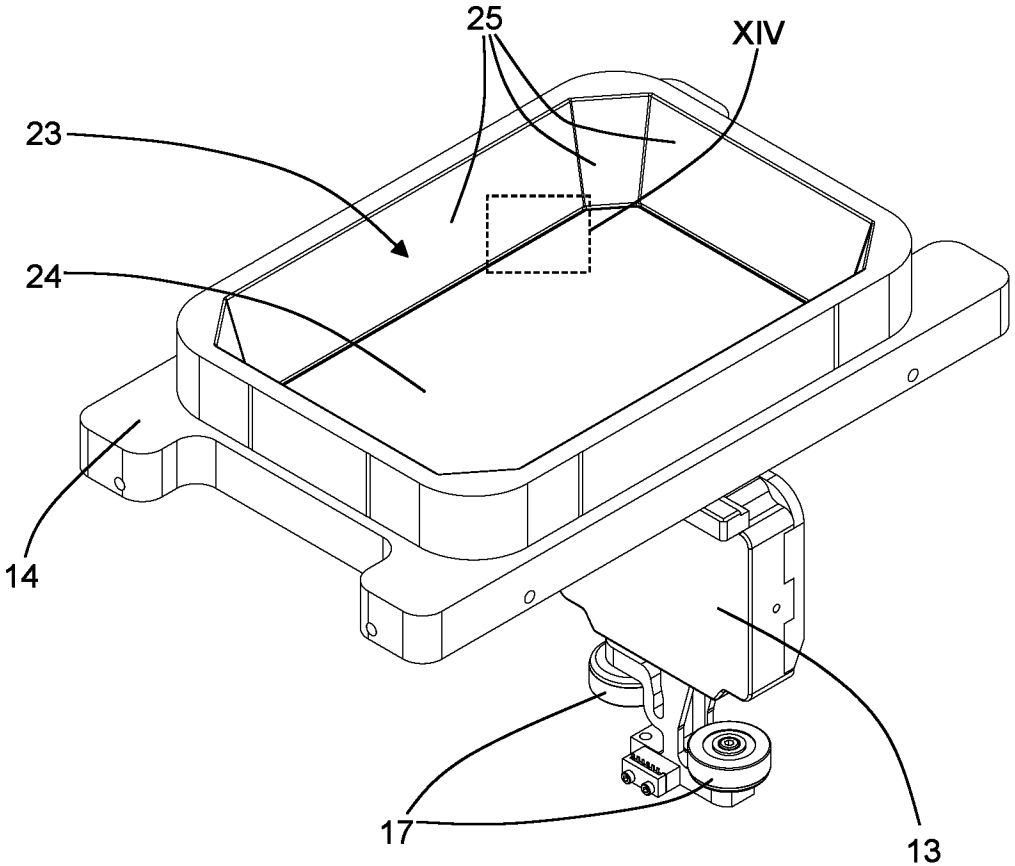
FIG. 7 is an axonometric view of a first embodiment of a supporting element coupled to a movement element.

Advantageously, the movement path is a closed path. For example, in the embodiment illustrated in FIG. 1, the movement path defined by the guide 5 has a substantially oval shape, clearly visible in FIG. 4. However, embodiments of the apparatus 1 are possible, in which the movement path is an open path, that is to say, in which the movement path extends between two different ends, as well as embodiments in which the closed movement path has a shape which is different from or more complex than that visible in the accompanying figures.

Preferably, in addition to the application station 6, at least one further processing station is associated with the movement path. In particular, multiple processing stations are advantageously associated with the movement path. In particular, the number and/or the type of processing stations depend on the type of apparatus 1.

In some embodiments, for example, in which the apparatus 1 is configured to apply the film 2 to a skeleton constituted of a single sheet, the stations comprise: a feeding station 7, at which a feeding device 8 for feeding the skeleton is positioned, the application station 6 for applying the film 2 to the skeleton, and an unloading station 9, at which an unloading device 10 for unloading the finished tray is positioned. In other embodiments such as those shown in FIGS. 1 to 6, in which the apparatus 1 is configured to apply the film 2 to a skeleton constituted of two sheets (respectively a first sheet and a second sheet), the processing stations also comprise a further feeding station 11, at which a further feeding device 12 is positioned. Each feeding device 8, 12 in this case feeds one of the two sheets.

In contrast, in embodiments in which the apparatus 1 is configured to apply the film 2 to a tray, the processing stations may advantageously comprise, for example, a feeding station 7, at which a feeding device 8 for feeding the tray is positioned, a positioning station, at which a positioning device for positioning the product on the tray is positioned, the application station 6 for applying the film 2 to the tray, and an unloading station 9, at which an unloading device 10 for unloading the pack is positioned.

Moreover this invention may be applied in apparatuses in which both the first type and the second type are simultaneously present; in these embodiments the processing stations advantageously comprise: the feeding station 7, at which the feeding device 8 for feeding the skeleton is positioned, the application station 6 for applying the film 2 to the skeleton (in such a way as to make the tray), the positioning station, at which the positioning device for positioning the product on the tray is positioned, the application station 6 for applying the film 2 to the tray (to thereby make the pack) and the unloading station 9, at which an unloading device 10 for unloading the pack is positioned. However, different embodiments are possible, in which processing stations which are different in type and/or number are associated with the movement path.

Although those indicated above are preferred embodiments, this invention may also be applied in the case in which only the application station 6 is associated with the movement path and feeding of the supports 3 to be processed and removal of the support 3 to which the film 2 has been applied are performed manually.

In any case, the number and/or the type and/or the positioning of the processing stations along the movement path, shall not be understood as limiting for this invention, since embodiments of the apparatus 1 are possible which comprise processing stations whose number and/or type and/or positioning, along the movement path, are different from what is described above.

Secondly, the apparatus 1 also comprises a movement element 13 and a supporting element 14, as well as the application device 4 previously introduced. The movement element 13 is movable along the movement path and, in use, is moved along the movement path.

If the guide 5 is present, the movement element 13 is advantageously slidably associated with the guide 5 and, in use, is moved along the movement path by the linear motors or by the planar motor of the guide 5. Similarly to what is indicated above with reference to the aspects strictly linked to operation of the guide 5 with linear motors, also the interaction between the guide 5 and the movement element 13 is an aspect which is in itself known to a person who is expert in the sector, and therefore will not be explained in detail in the following description.

If a different type of conveyor is provided, the movement element 13 is in contrast associated with the conveyor and moved by it.

Figure 10:
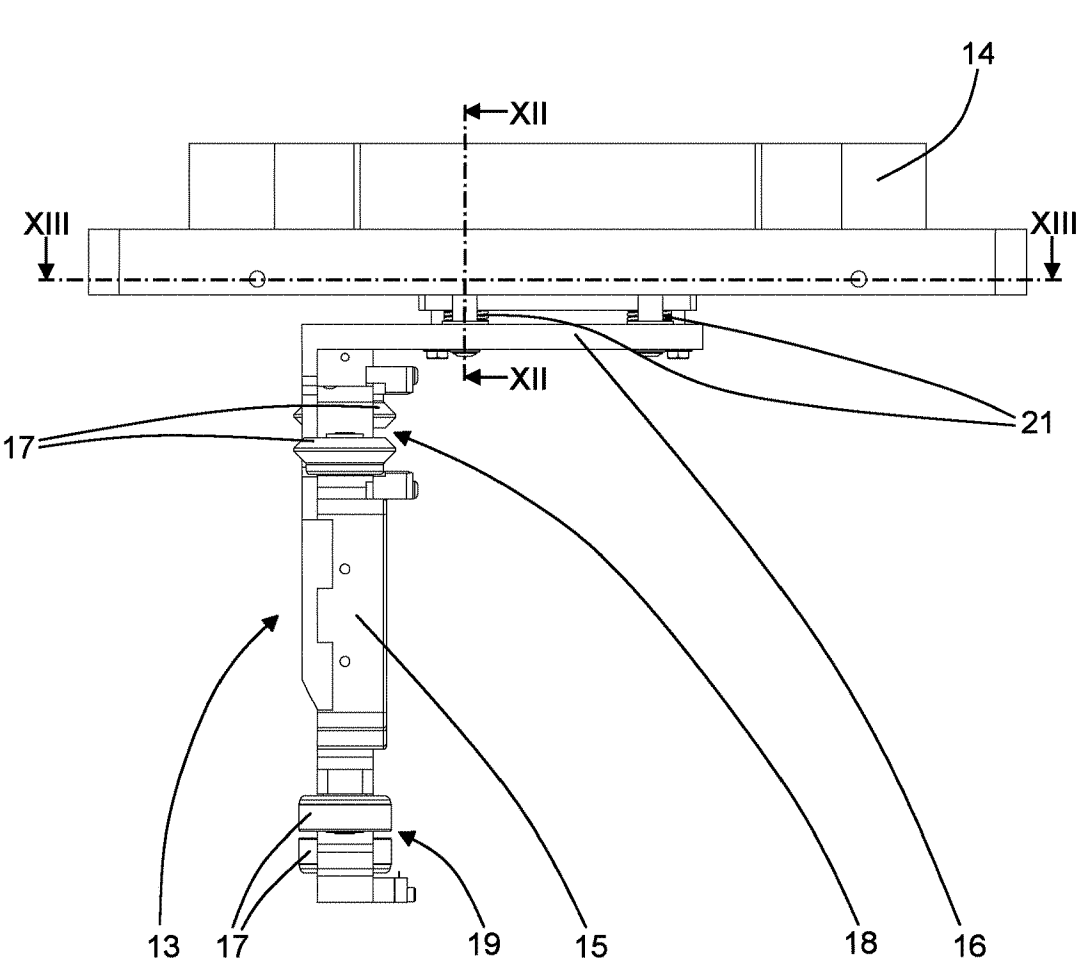
FIGS. 9 and 10 show, respectively in a front view and in a side view, the supporting element and the movement element of FIG. 8.
Figure 9:
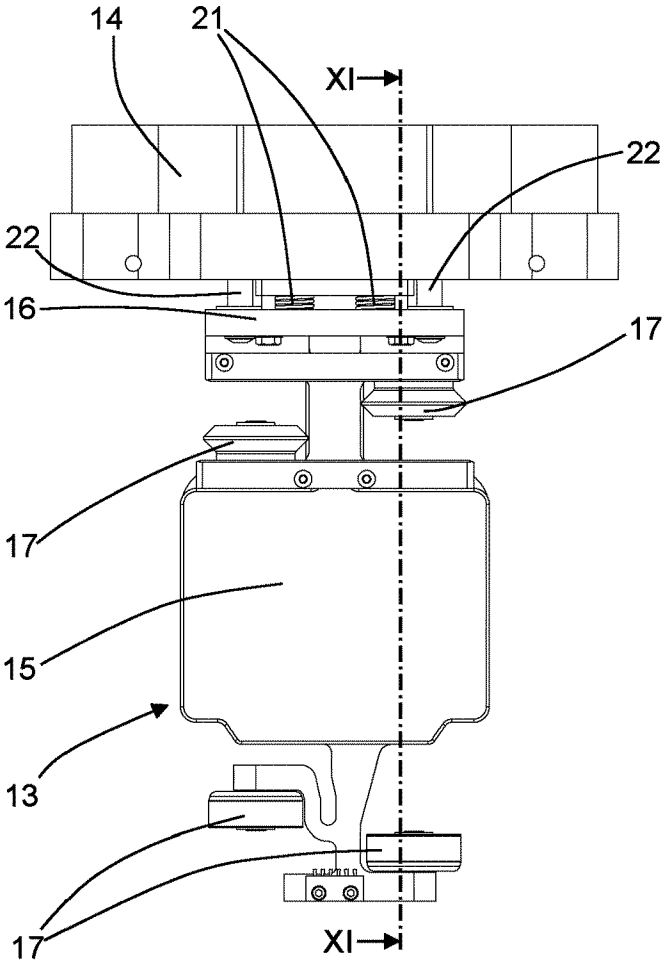
Figure 12:
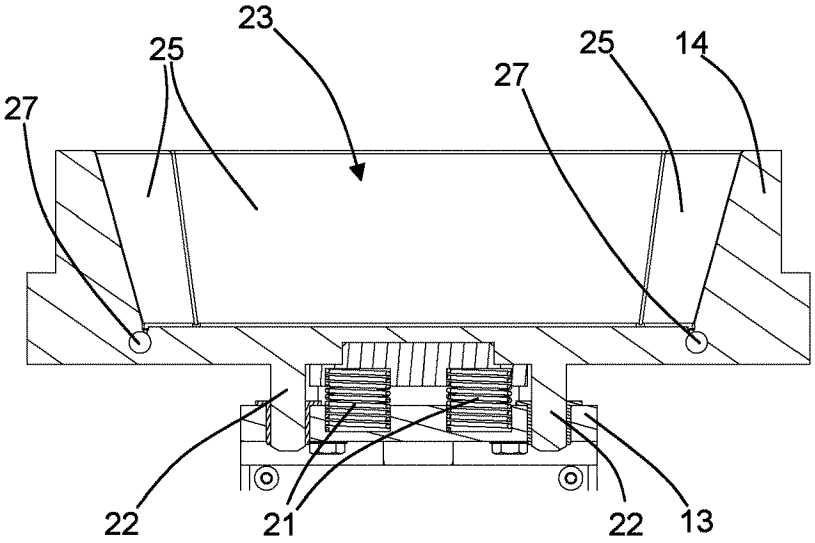
FIG. 12 shows, in a front view vertical section, a detail of the supporting element and of the movement element of FIG. 10 which are sectioned according to the section line XII-XII.
Figure 11:
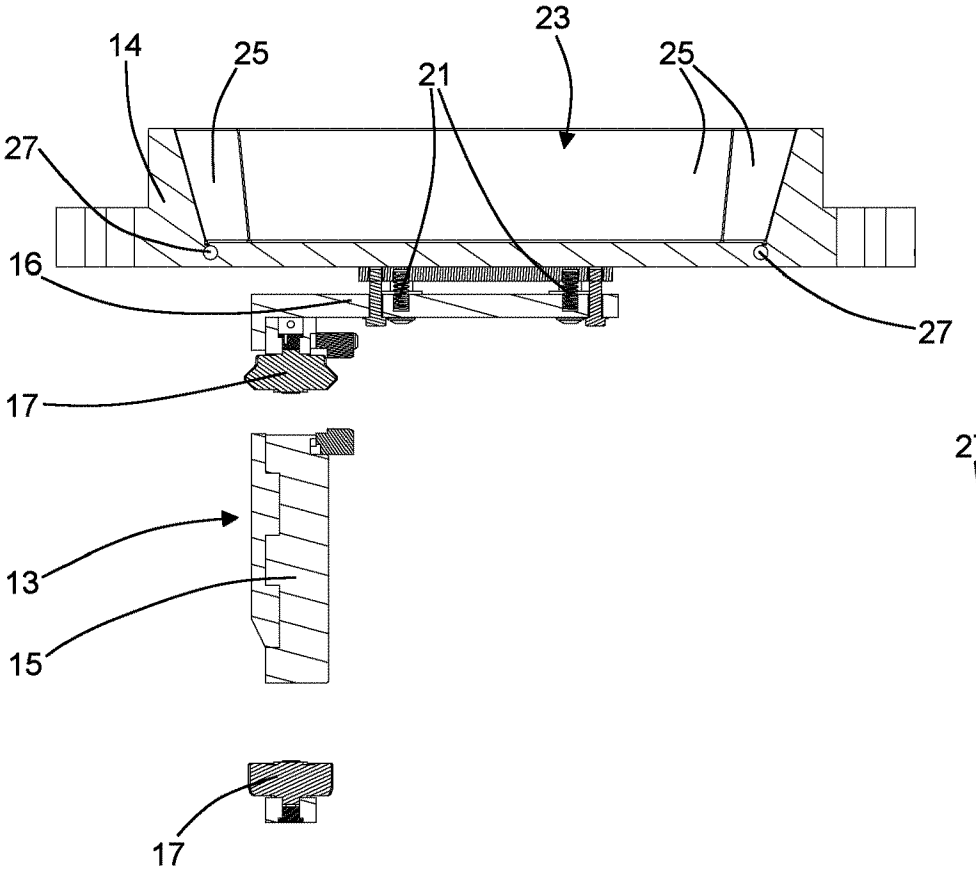
FIG. 11 shows, in a side view vertical section, the supporting element and the movement element of FIG. 9 which are sectioned according to the section line XI-XI.
Figure 18:
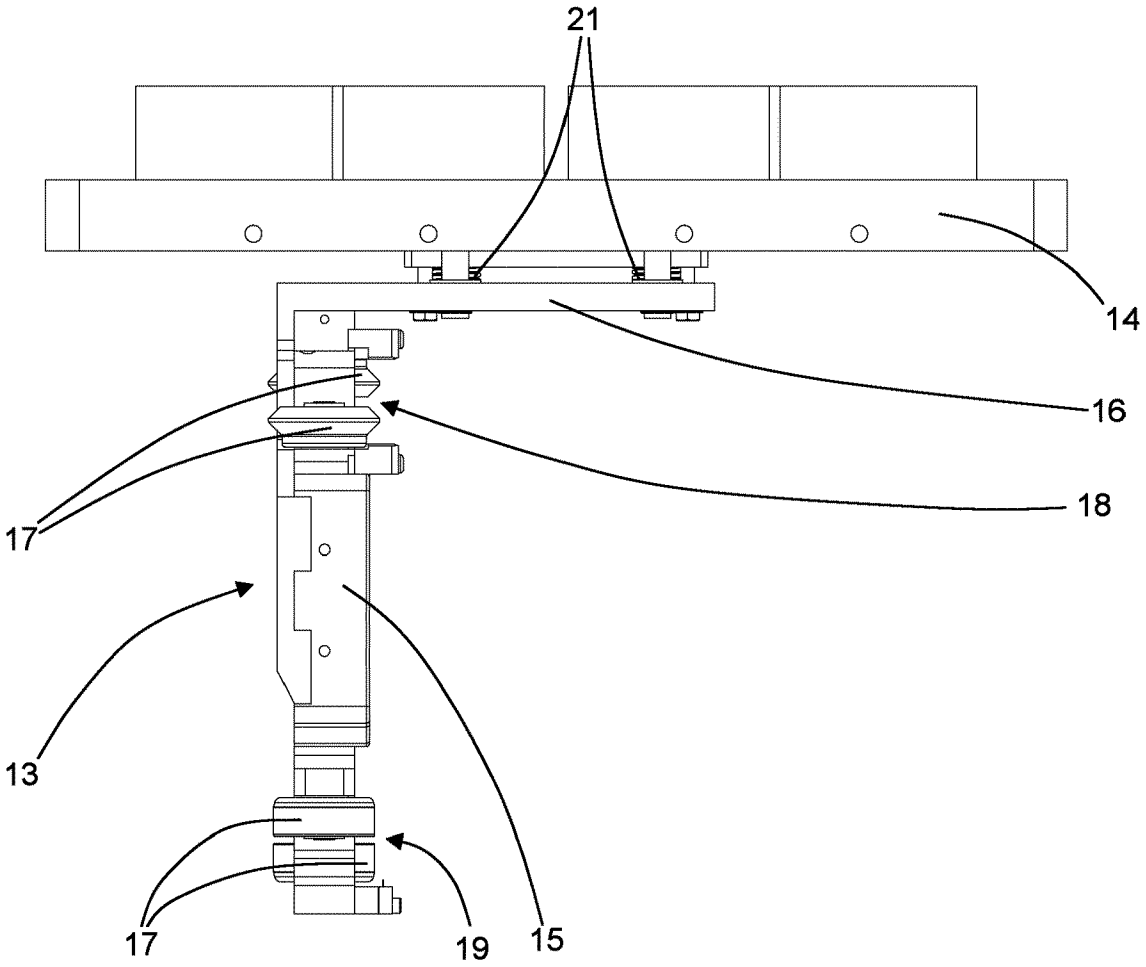
FIGS. 17 and 18 show, respectively in a front view and in a side view, the supporting element and the movement element of FIG. 16.
Figure 17:
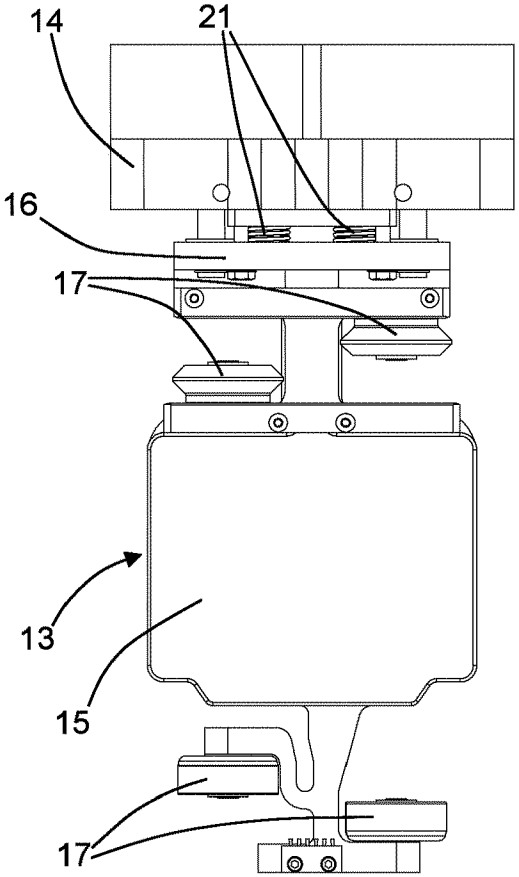

In the embodiment illustrated in FIGS. 1 to 37, the movement element 13 substantially has an (upside down) L shape, and comprises a first portion 15 (substantially the vertical body of the L) and a second portion 16 (substantially the horizontal body of the L), as is clearly visible in particular in FIGS. 10 and 18.

In the embodiments of FIGS. 39 to 45, the movement element 13 in contrast substantially has an I shape and comprises a first portion 15 (substantially the main body of the I) and a second portion 16 (the top of the I).

In more detail, the first portion 15 is positioned at one side of the guide 5 (not illustrated in FIGS. 38 to 45), in FIGS. 1 to 37 the outer side of the guide 5, and is arranged substantially vertical. Moreover, the first portion 15 is magnetically coupled to the guide 5 to allow the movement of the whole movement element 13 along the guide 5. In contrast, the second portion 16 is positioned above the guide 5 and is arranged substantially horizontally. Moreover, the second portion 16 of the movement element 13 is coupled to the supporting element 14 as described in more detail below. For that purpose, in the embodiment illustrated, there are through holes made in the second portion 16.

The movement element 13 also comprises at least one rotating element 17, which is substantially a wheel, rotatably connected to the first portion 15 according to a vertical axis of rotation and which is coupled to the guide 5. The rotating element 17 rotates, about the vertical axis of rotation, as a result of contact with the guide 5 itself. The presence of the rotating element 17 is advantageous since it facilitates the movement of the movement element 13 relative to the guide 5. In the preferred embodiments, the movement element 13 comprises a plurality of rotating elements 17. For example, in the embodiments illustrated in FIGS. 1 to 37, the movement element 13 comprises four rotating elements 17, which are arranged in pairs: a first pair 18 of rotating elements 17 is placed at an upper zone of the first portion 15, whilst a second pair 19 of rotating elements 17 is placed at a lower zone of the first portion 15 (with the upper zone nearer to the second portion 16 than the lower zone). In particular, the rotating elements 17 of the first pair 18 of rotating elements 17 are coupled to a pair of grooves 20 which are made in the guide 5, whilst the rotating elements 17 of the second pair 19 of rotating elements 17 are coupled to a portion of the guide 5 which is substantially flat. The rotating elements 17 of each pair 18, 19 are advantageously shaped to match the surface of the guide 5 with which they are in contact. The presence of two pairs 18, 19 of rotating elements 17 is advantageous since it allows greater stability to be given to the movement element 13 during its movement along the guide 5. What is described above is clearly visible in the detail shown in FIG. 6.

Advantageously, the combination of the magnetic attraction applied by the linear motors on the movement element 13 and the interaction between the rotating elements 17 and the grooves 20 (or the flat portion) holds the movement element 13 in the correct position relative to the guide 5.

The supporting element 14 is coupled to the movement element 13 and is movable with it along the movement path; in particular, in the embodiments illustrated, the supporting element 14 is coupled to the second portion 16 of the movement element 13. Advantageously, the supporting element 14 is also movable relative to the movement element 13 along a vertical line. In some embodiments, for the coupling between the supporting element 14 and the movement element 13, the apparatus 1 comprises at least one elastic element 21, which allows the movement of the supporting element 14 relative to the movement element 13, as will be described in detail below. Moreover, in the embodiment of FIGS. 1 to 37 the supporting element 14 comprises projecting portions 22 which are slidably inserted through the through holes made in the second portion 16 of the movement element 13 to guide the movement of the supporting element 14 relative to the movement element 13.

The supporting element 14 defines at least one housing 23 for housing, in use, the support 3. In some embodiments, in which the support 3 has a tub shape, the housing 23 has a bottom surface 24, which may be configured to make contact with and to support the bottom wall of the support 3, a plurality of lateral surfaces 25, which may be configured to make contact with the lateral walls of the support 3, and an annular frame 26, which is configured to make contact with and to support the flange of the support 3. In accordance with what was previously described for the support 3, further embodiments of the supporting element 14 are possible which define a different housing 23, compared with the one described above, based on the support 3 to be housed: the person in the sector will be capable of selecting the type of housing 23, defined by the supporting element 14, suitable for the type of support 3 on which the film 2 must be applied.

In some embodiments, the supporting element 14 defines a plurality of housings 23, each of which is configured to receive a different support 3. For example, the supporting element 14 shown in FIGS. 15 to 18 defines two housings 23 side by side, which are identical. Also possible are embodiments, which are shown for example in FIGS. 40 and 41, in which the supporting element 14 defines a plurality of housings 23 numbering more than two and/or whose shapes differ from each other.

In general, some of the apparatuses 1 according to this invention involve evacuation of the air from the housing 23 (and creation of the vacuum or introduction of gas) at least during application of the film 2; in fact, as described below, during operation of the apparatus 1 the supporting element 14 also acts as a component of the application device 4 for application of the film 2 to the support 3. Although this aspect will be described in detail below, it is appropriate to describe several structural characteristics of the supporting element 14 relative to this aspect.

Advantageously made in the supporting element 14 there is a plurality of first ducts 27 which are in fluid communication with the housing 23 and, preferably, with each other.

In the preferred embodiments, the first ducts 27 are in fluid communication with the housing 23 through their final ends which define openings 31 at an inner surface of the supporting element 14. Those openings 31 are preferably made in the supporting element 14 at zones which, in use, are not entirely obstructed by the support 3 (in other words, when the support 3 is placed inside the housing 23, the fluid communication between the first ducts 27 and the housing 23 is not prevented by the support 3).

Figure 14:
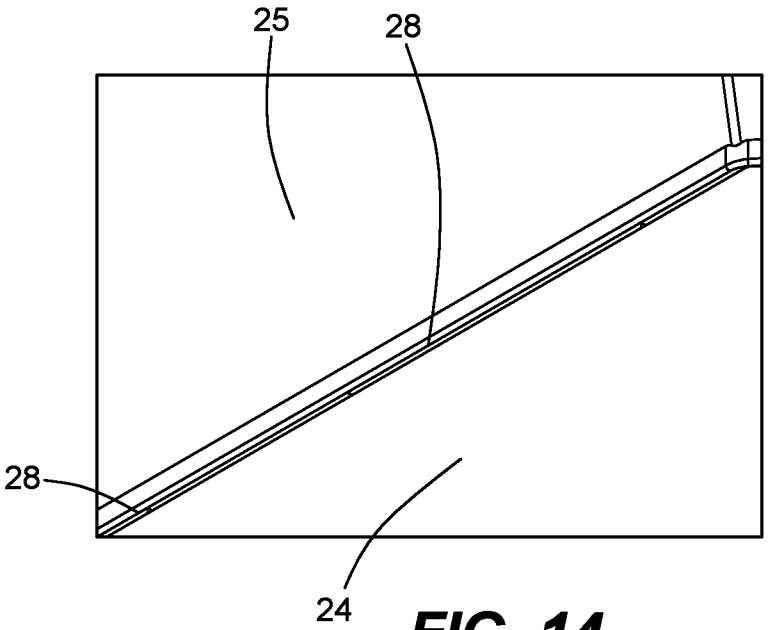
FIG. 14 is an enlarged view of the detail XIV of FIG. 7.
Figure 13:
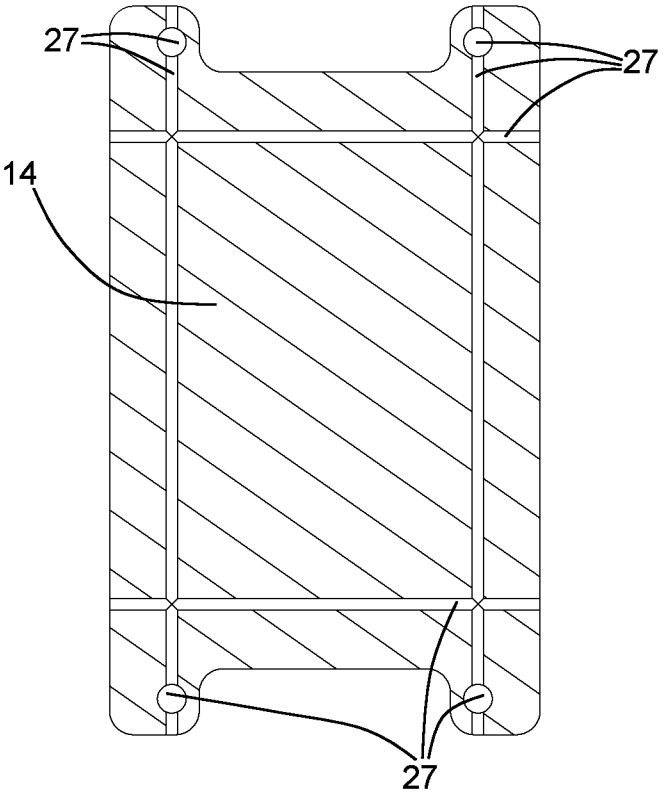
FIG. 13 shows, in a top view horizontal section, the supporting element and the movement element of FIG. 10 which are sectioned according to the section line XIII-XIII.
Figure 16:
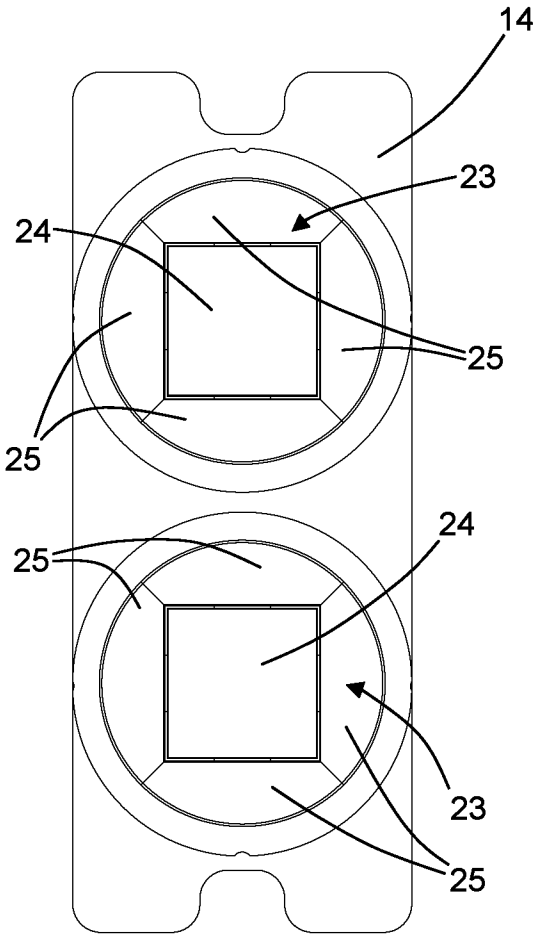
FIG. 16 is a top view of the supporting element and the movement element of FIG. 15.
Figure 15:
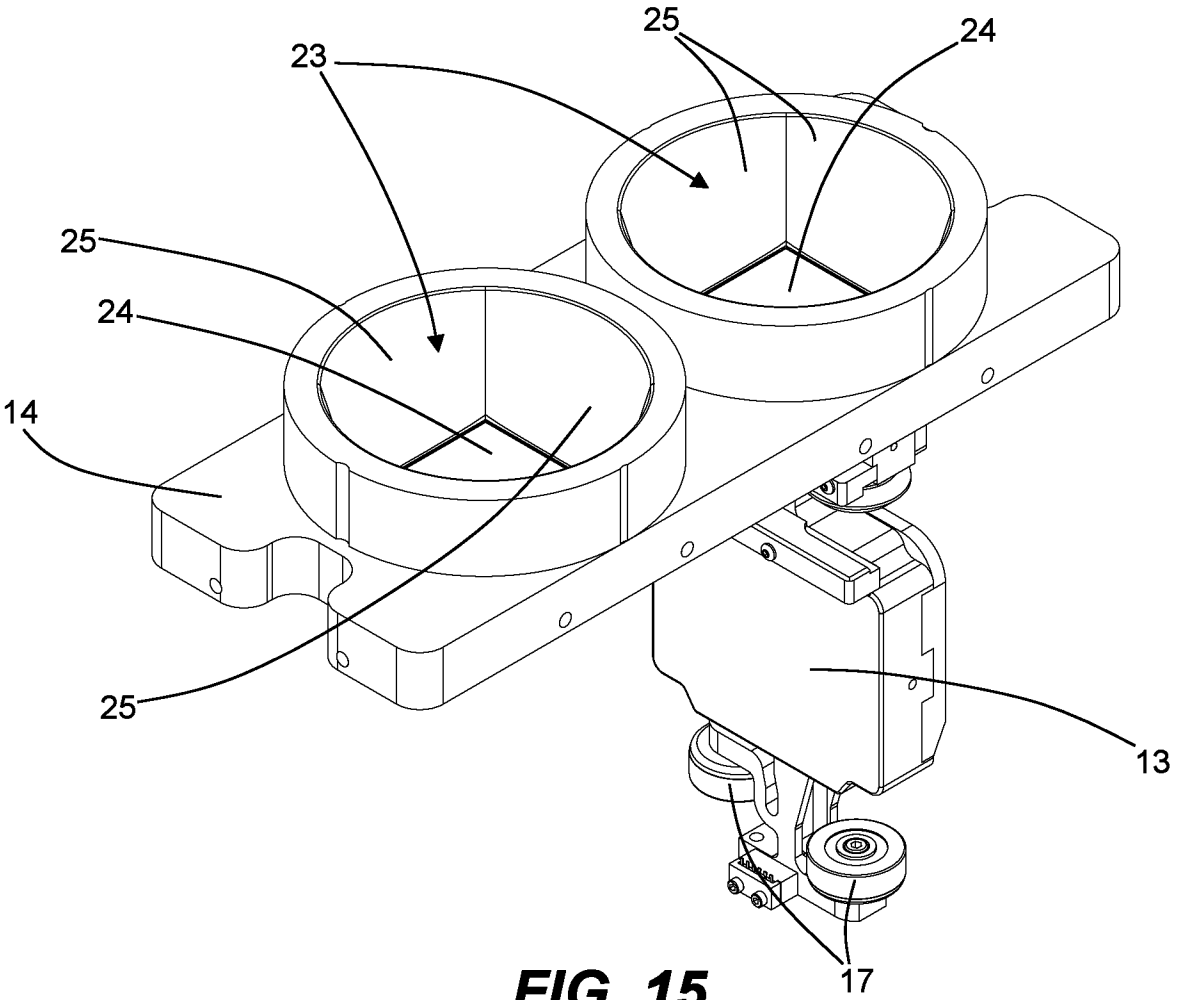
FIG. 15 is an axonometric view of a second embodiment of the supporting element coupled to the movement element of FIG. 7.

In some embodiments of the supporting element 14, such as that shown in FIGS. 7 to 14 and that shown from 15 to 18, those openings 31 are substantially slits 28 (as can be seen in the detail of FIG. 14). In particular, in these embodiments, the slits 28 are placed at a connecting zone between the bottom surface 24 and the lateral surfaces 25 of the housing 23. In more detail, the slits 28 are located at that connecting zone since the apparatus 1 which advantageously comprises those supporting elements 14, is configured to apply the film 2 on a support 3 which has cuts in a zone which, when the support 3 is placed in the housing 23, is superposed on the slits 28.

As already described, that allows fluid communication between the first ducts 27 and the housing 23 through those slits 28. Solutions of this type are advantageous if the application device 4 is a vacuum sealing machine, a skin packaging machine or a thermoforming machine.

Figure 19:
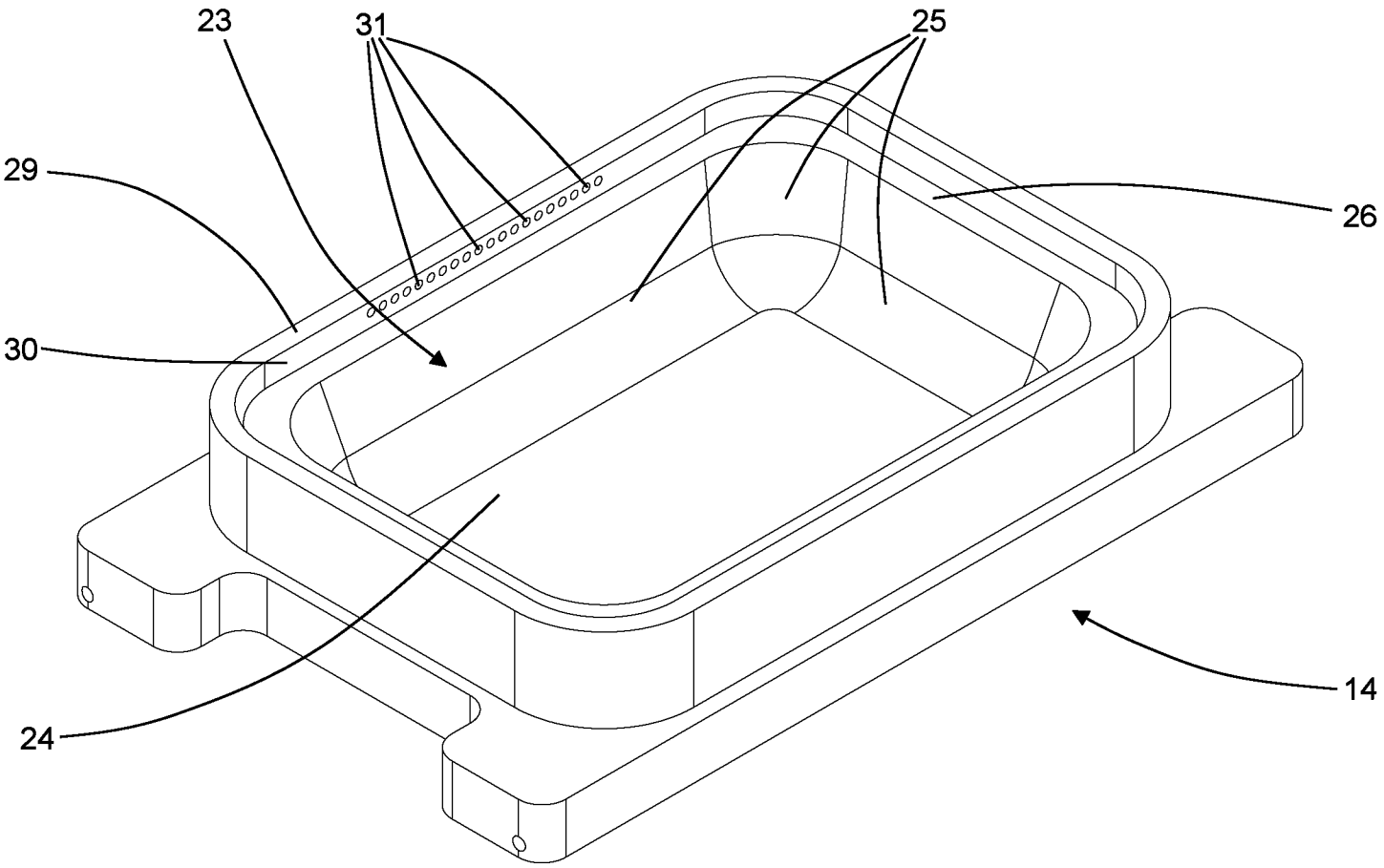
FIG. 19 is an axonometric view of a third embodiment of the supporting element.
Figure 21:
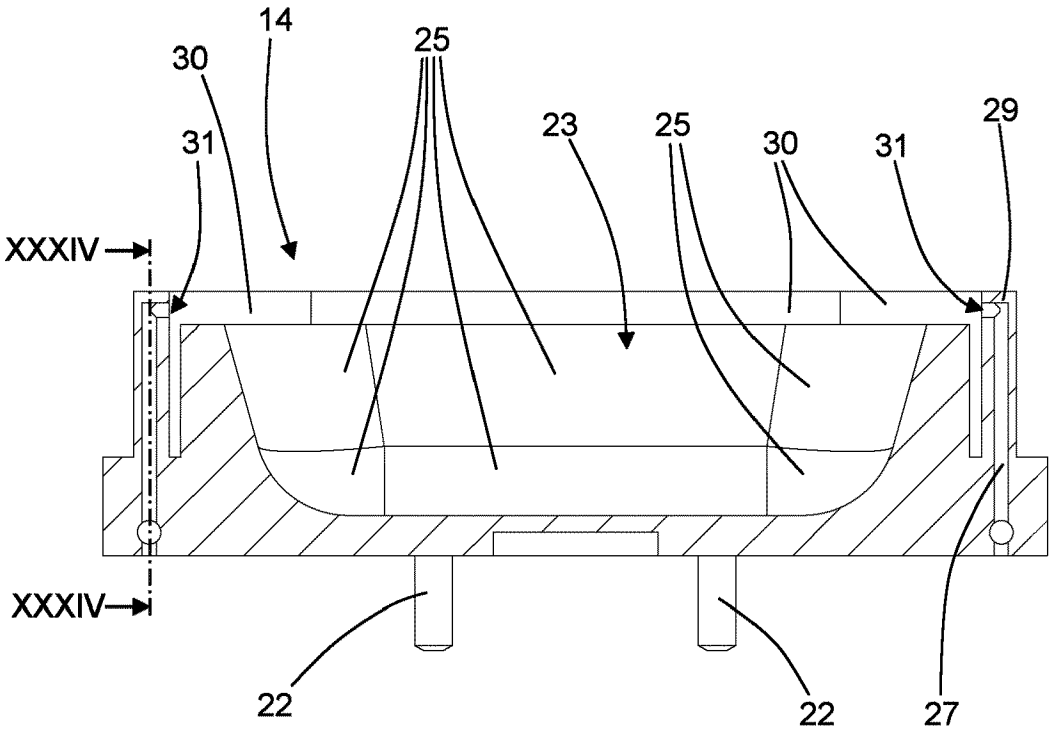
FIG. 21 shows, in a front view vertical section, the supporting element of FIG. 20 sectioned according to the section line XXI-XXI.
Figure 20:
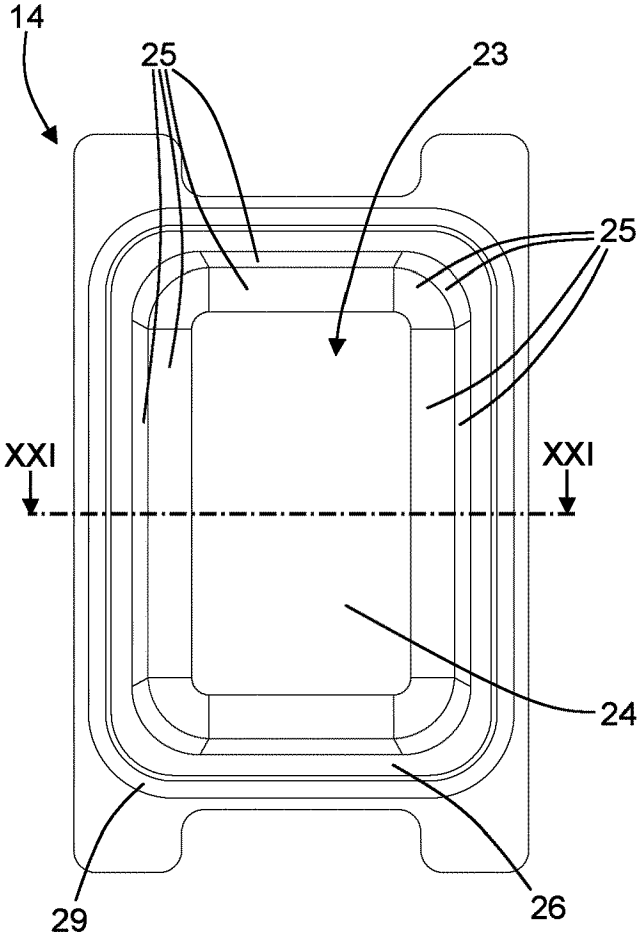
FIG. 20 is a top view of the supporting element of FIG. 19.

In other embodiments of the supporting element 14, such as that shown in FIGS. 19 to 21, it comprises a raised portion 29 which extends upwards outside the annular frame 26 and which defines a perimetric surface 30 directed inwards towards the inside of the housing 23. The openings 31 which put the first ducts 27 made in the supporting element 14 in fluid communication with the housing 23 are made at the perimetric surface 30.

In contrast, in the embodiment of FIGS. 40 to 45, the openings 31 of the first ducts 27 are made at the lateral surfaces 25 of the housings 23. Advantageously there are also many openings 31 present, densely distributed alongside each other along all of the lateral surfaces 25.

It should be emphasised that those described are just some of the possibilities, since other embodiments are possible which differ in the positioning and the shape of the openings 31 and/or their number. Solutions of this type are advantageous if the application device 4 is a modified atmosphere sealing machine.

In any case, the aspects linked to the first ducts 27 and to the fluid communication between the first ducts 27 and the housing 23 through the slits 28 will be described in more detail below anyway.

In contrast, regarding the application device 4, it is associated with the movement path at the application station 6. Moreover, the application device 4 is configured to apply, in use, the film 2 to the support 3 when the supporting element 14 is placed at the application station 6.

The application device 4 comprises a closing element 32 and a contact element 33 which are configured to associate, in use, with the supporting element 14 when the support 14 when the supporting element 14 is placed at the application station 6. Moreover, when the supporting element 14 is placed at the application station 6, the supporting element 14 too is part of the application device 4 and is interposed between the closing element 32 and the contact element 33.

Figure 23:
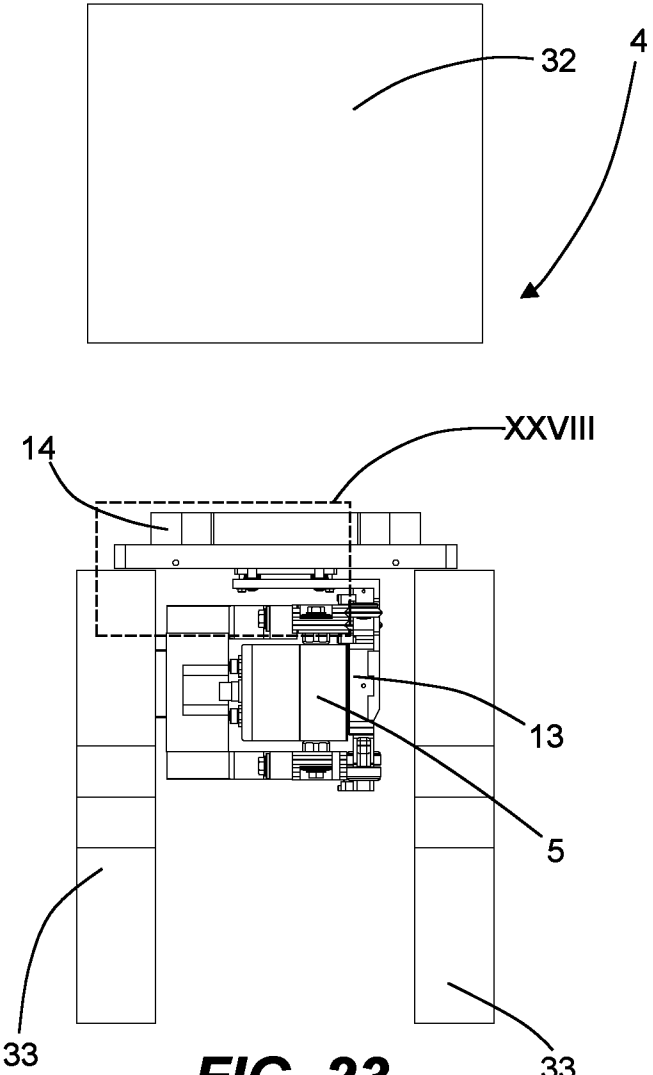
FIGS. 23 and 24 show, respectively in a front view and in a side view, the application device and the portion of the guide of FIG. 22.
Figure 22:
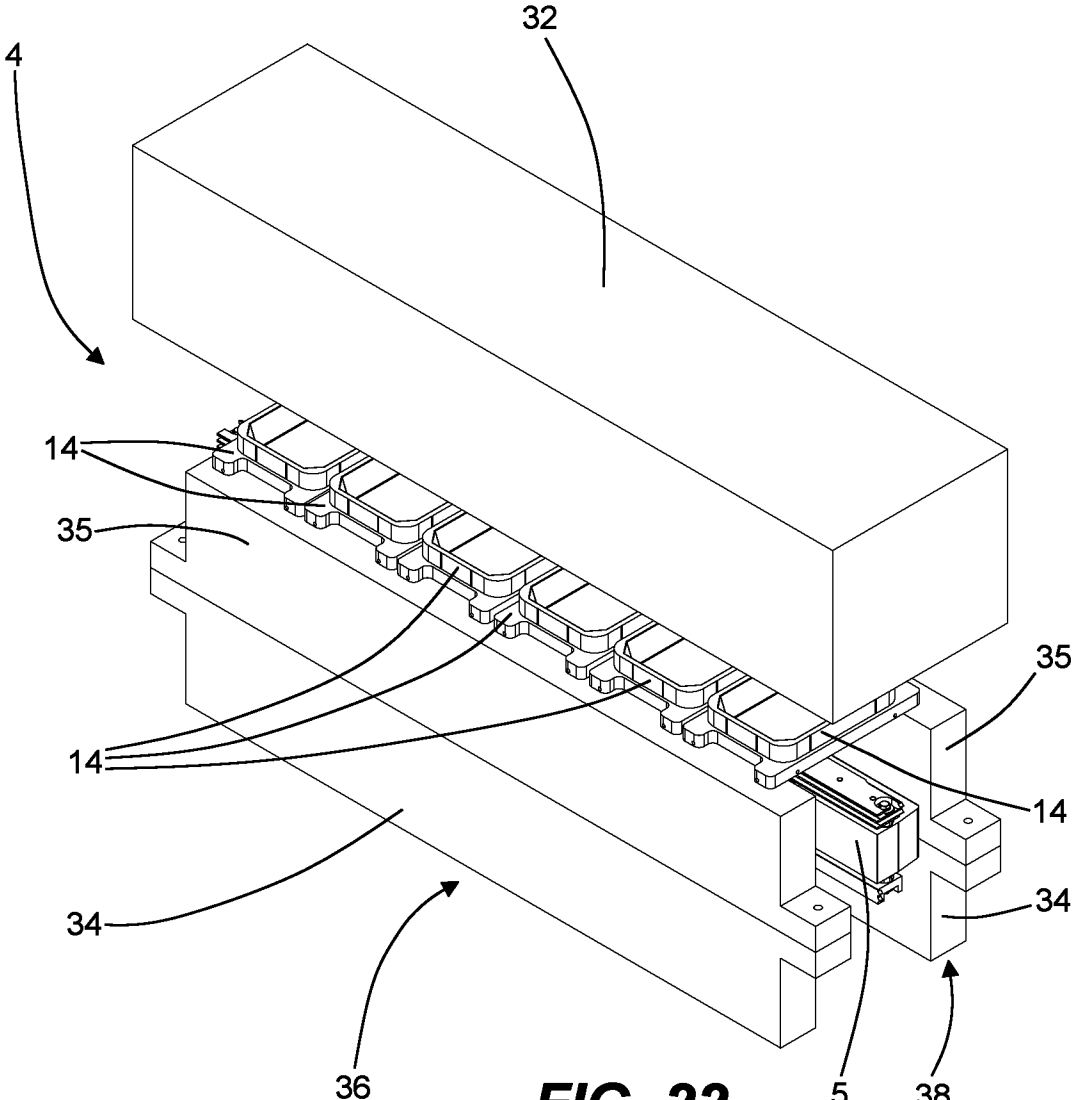
FIG. 22 is an axonometric view of an application device of the apparatus of FIG. 1 and a portion of guide, with closing elements and the respective supporting elements in an opening position.
Figure 24:
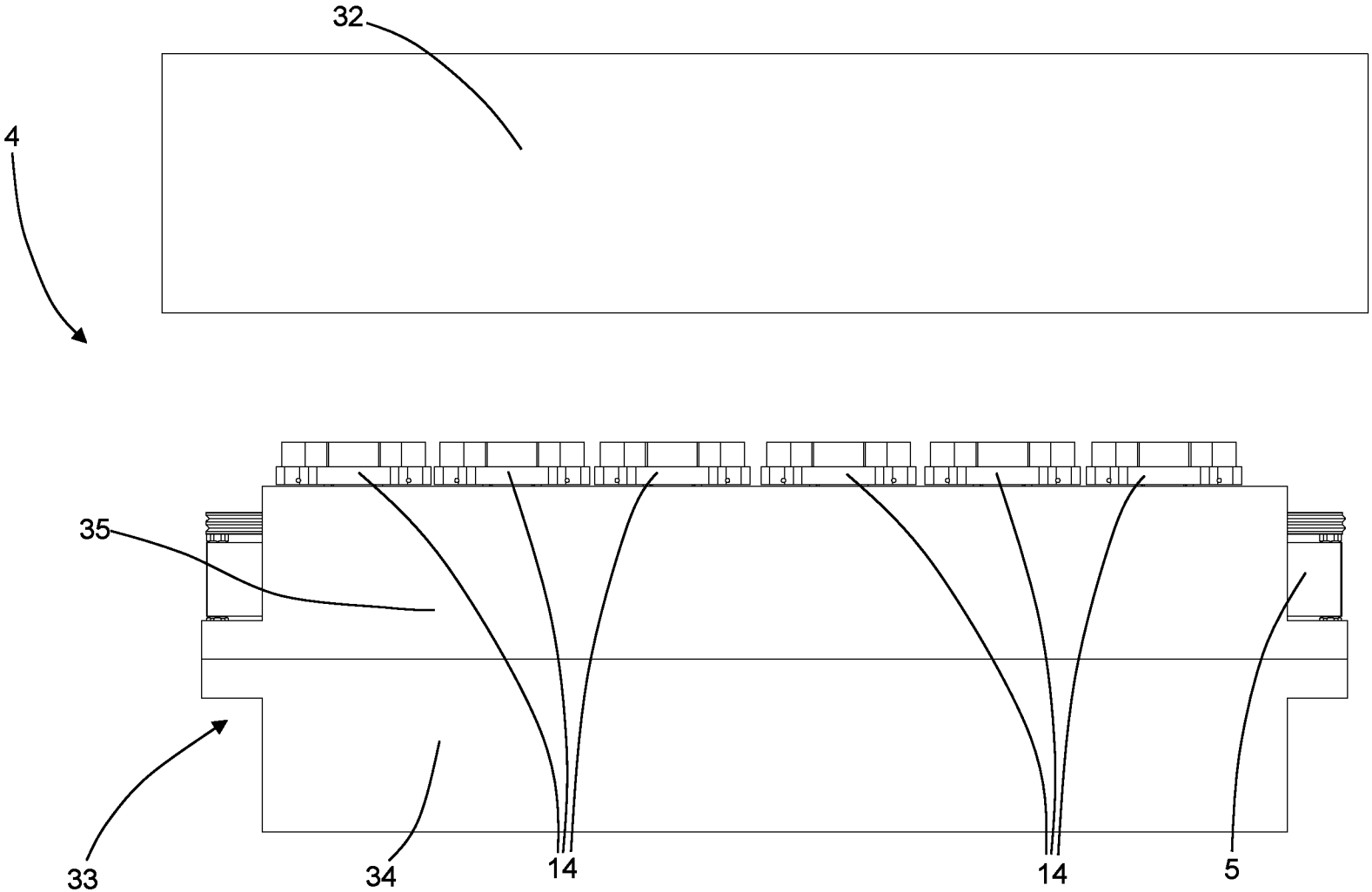
Figure 26:
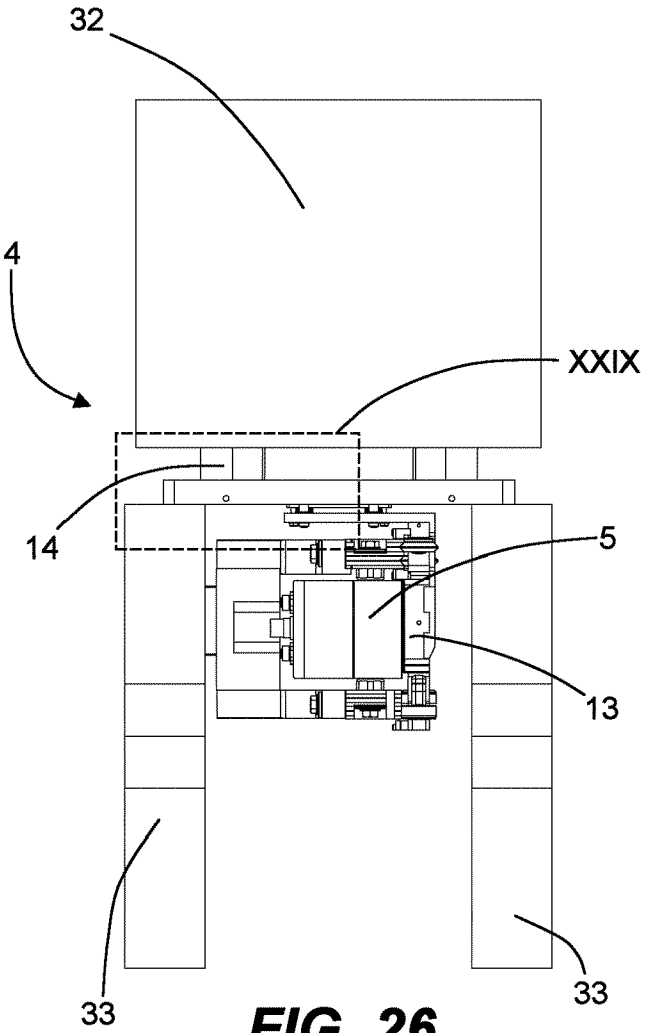
FIGS. 26 and 27 show, respectively in a front view and in a side view, the application device and the portion of the guide of FIG. 25.
Figure 25:
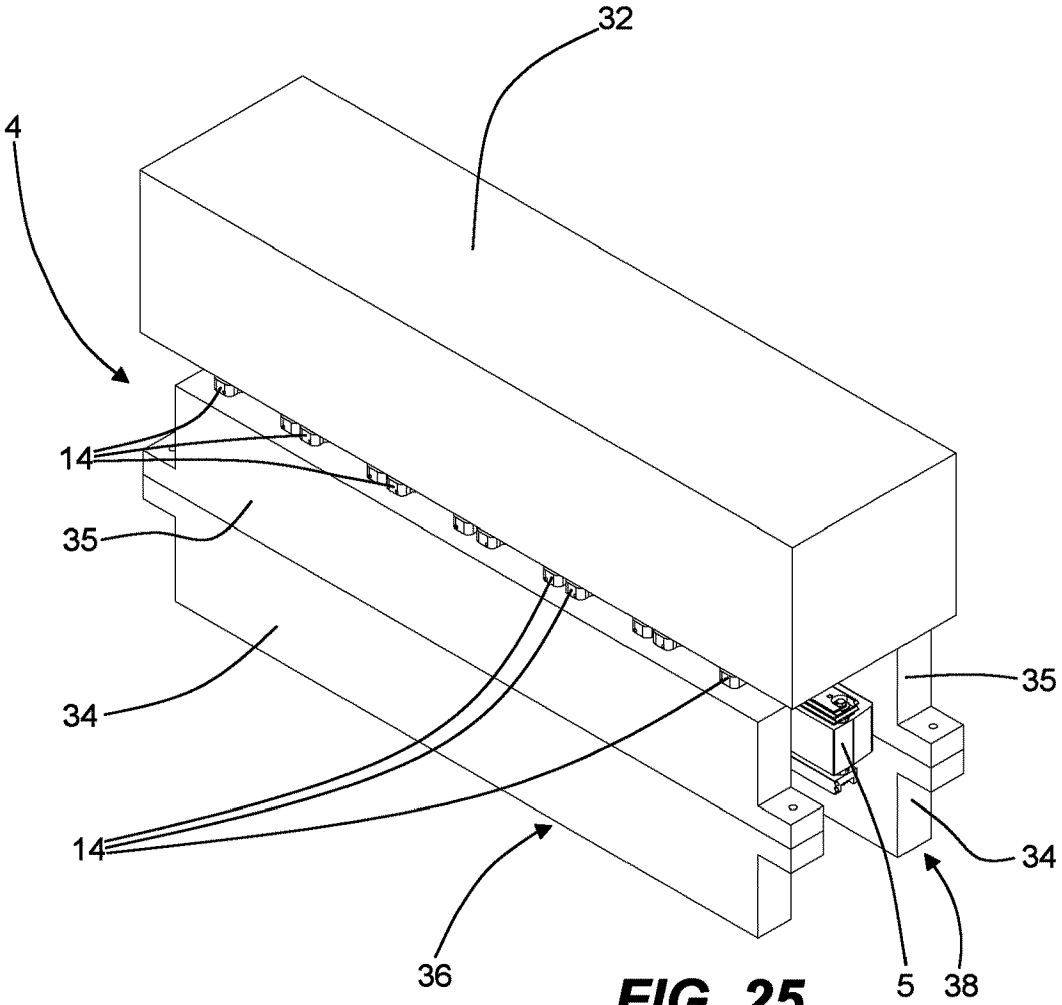
FIG. 25 is an axonometric view of the application device and the portion of the guide of FIG. 22, with the closing elements and the respective supporting elements in a closing position.
Figure 27:
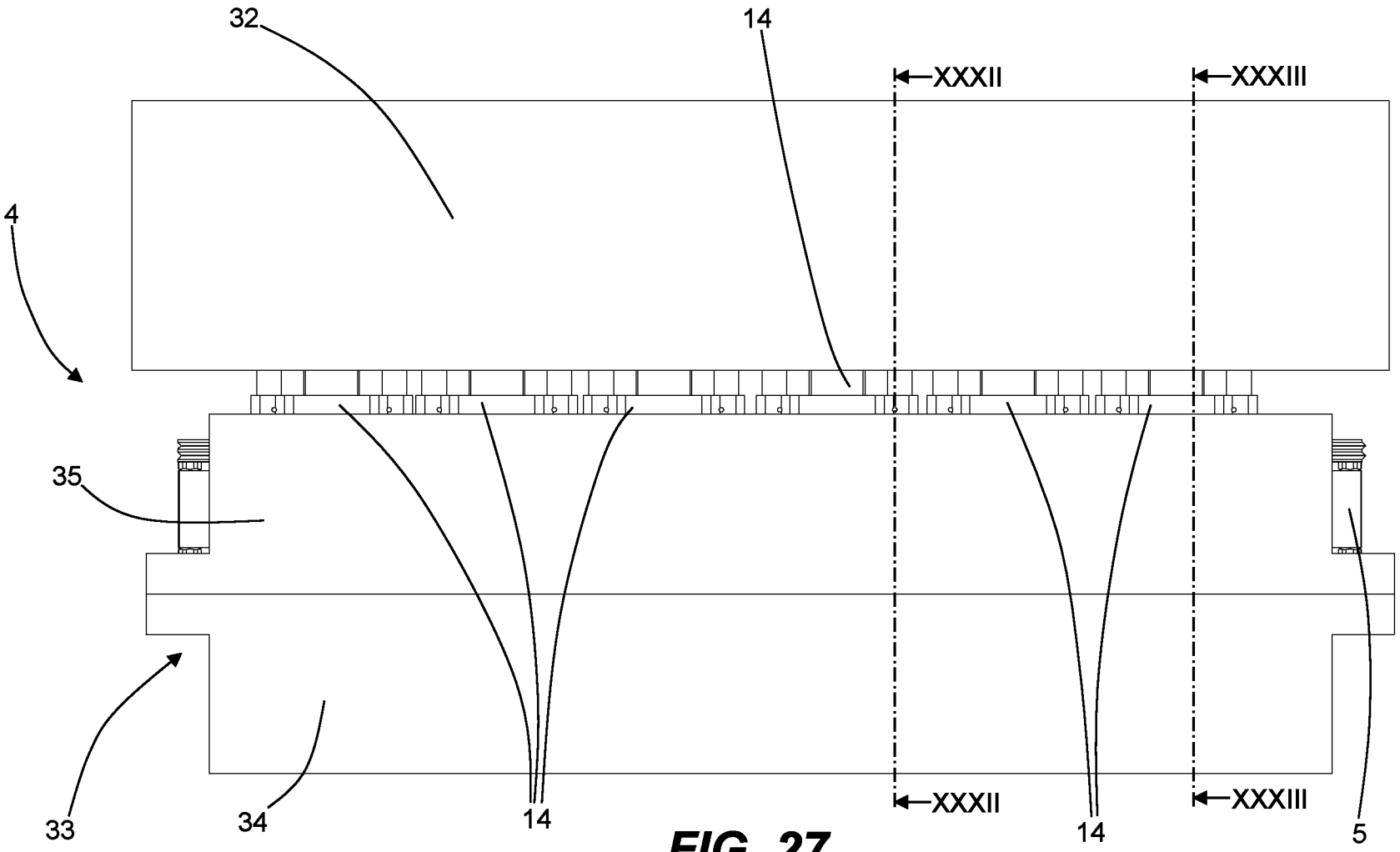
Figure 30:
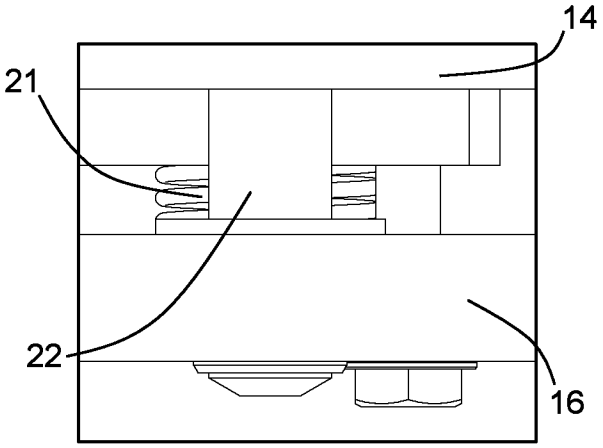
FIG. 30 is a further enlarged view of the detail XXX of FIG. 28.
Figure 31:
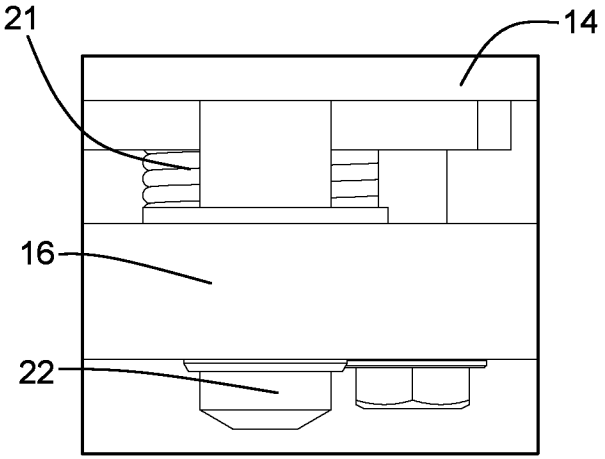
FIG. 31 is a further enlarged view of the detail XXXI of FIG. 29.
Figure 28:
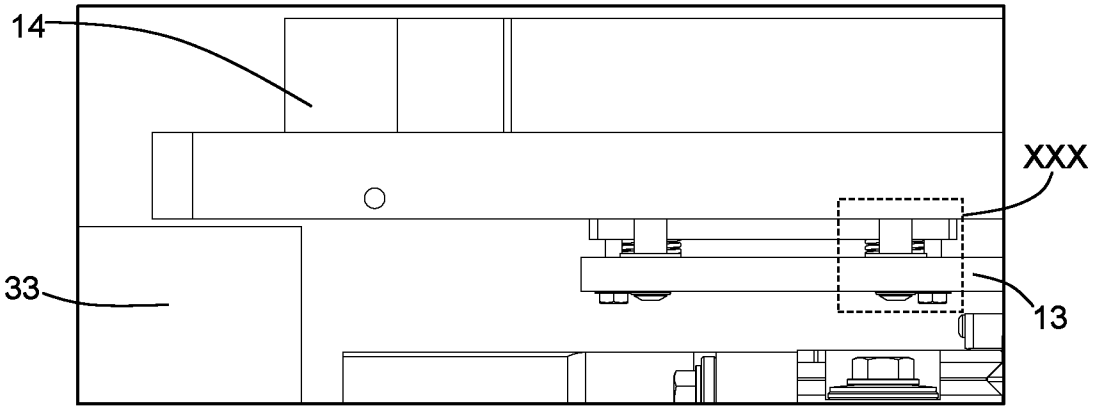
FIG. 28 is an enlarged view of the detail XXVIII of FIG. 23.
Figure 29:
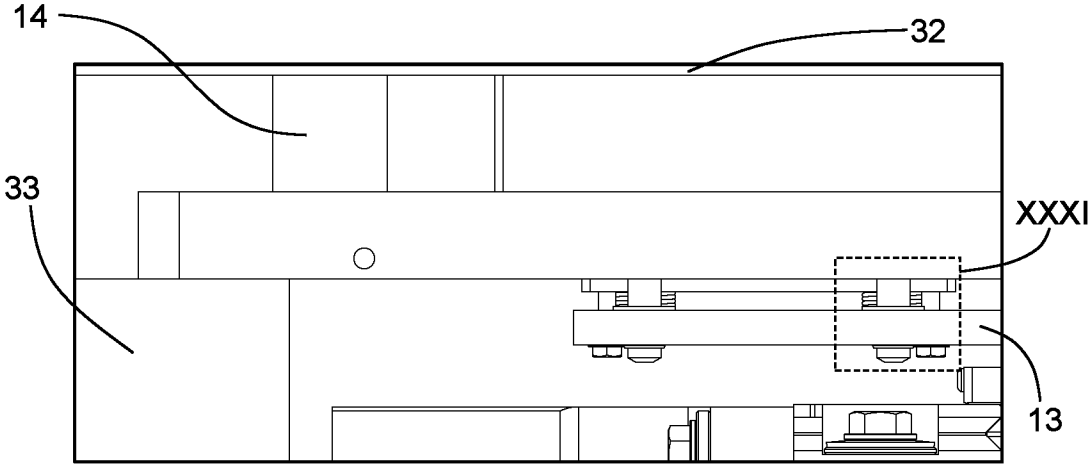
FIG. 29 is an enlarged view of the detail XXIX of FIG. 26.
Figure 33:
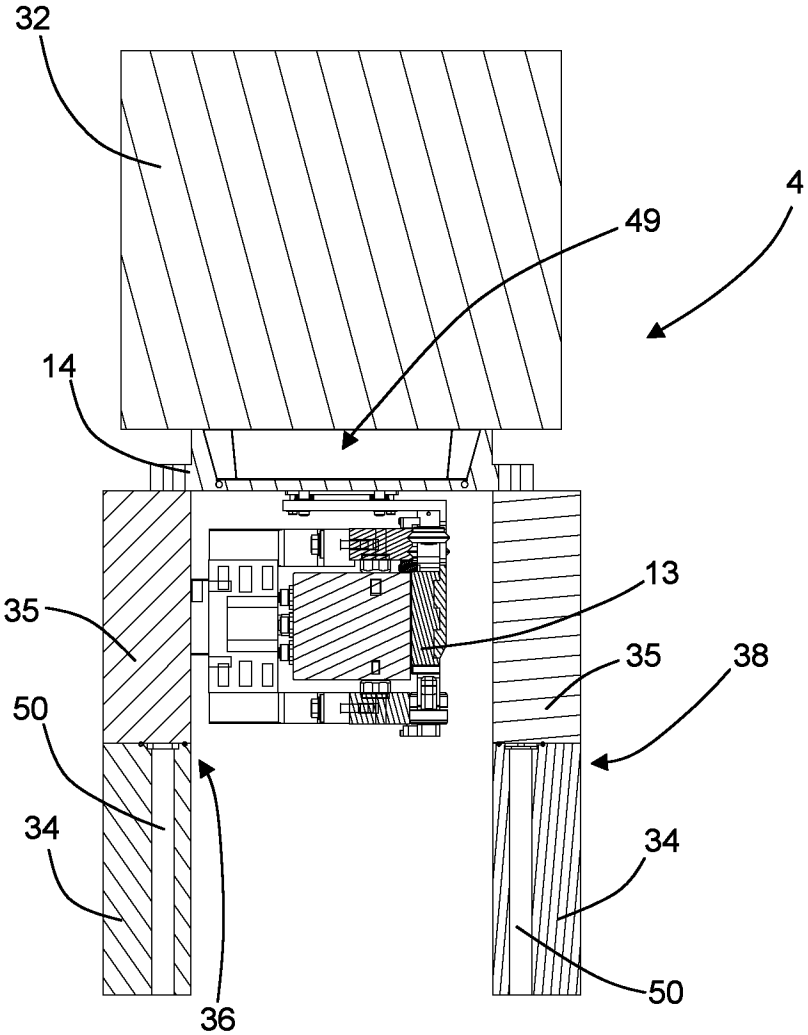
FIG. 33 shows, in a front view vertical section, the application device and the portion of the guide of FIG. 27 which are sectioned according to the section line XXXIII-XXXIII.
Figure 32:
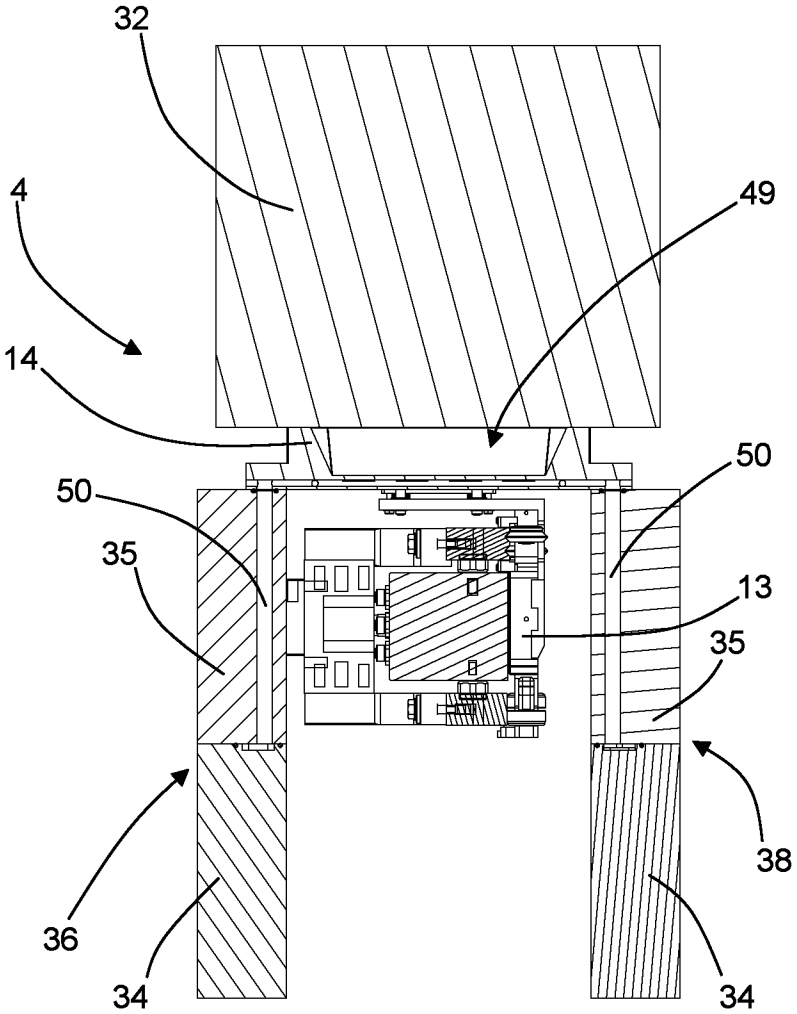
FIG. 32 shows, in a front view vertical section, the application device and the portion of the guide of FIG. 27 which are sectioned according to the section line XXXII-XXXII.
Figure 35:
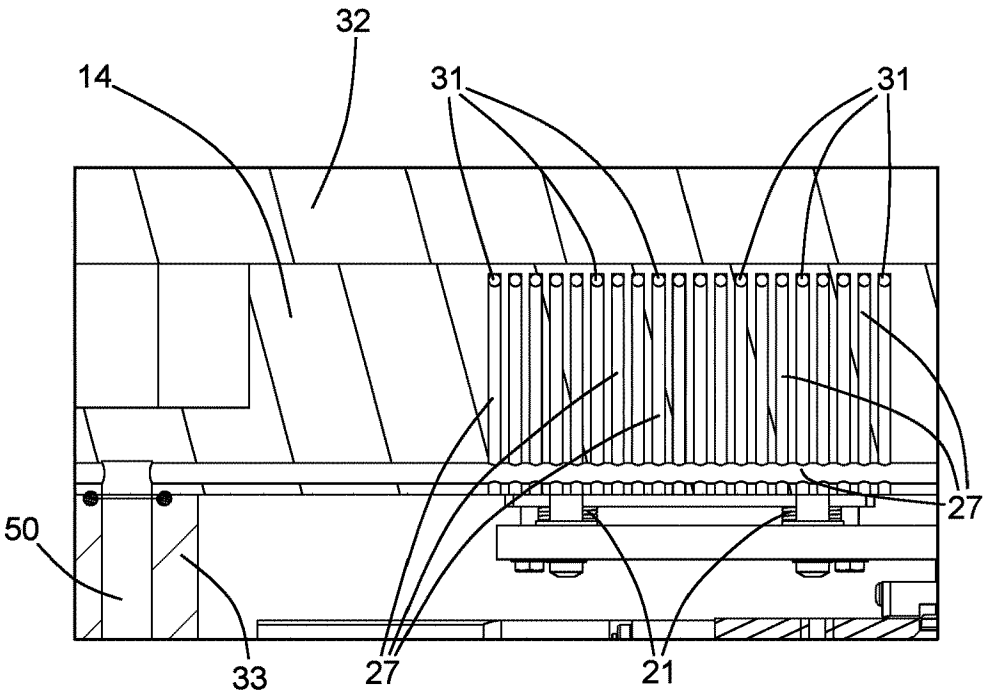
FIG. 35 is an enlarged view of the detail XXXV of FIG. 34.
Figure 34:
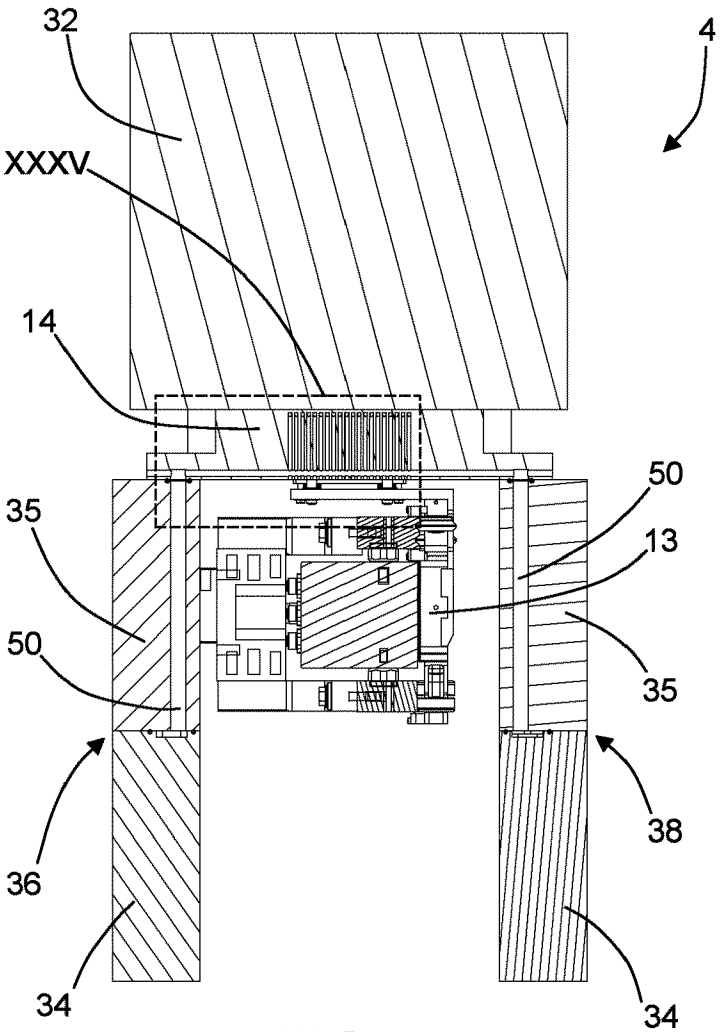
FIG. 34 shows, in a front view vertical section, an application device, with the supporting element of FIG. 19, and a portion of guide which are sectioned according to the section line XXXIV-XXXIV of FIG. 21.

With reference to the closing element 32, when the supporting element 14 is placed at the application station 6, the supporting element 14 and the closing element 32 are movable at least one relative to the other, between an opening position and a closing position. When the closing element 32 and the supporting element 14 are in the opening position, the closing element 32 and the supporting element 14 are uncoupled and spaced apart from each other. In contrast, when the closing element 32 and the supporting element 14 are in the closing position, the closing element 32 and the supporting element 14 are coupled to each other to apply, in use, the film 2 to the support 3; moreover, when the closing element 32 and the supporting element 14 are in the closing position, the supporting element 14 is advantageously clamped between the closing element 32 and the contact element 33. The closing element 32 and the supporting element 14 in the opening position are shown in FIGS. 22 to 24 (and some details are shown in FIGS. 28 and 30) and in FIGS. 38 to 43, whilst the closing element 32 and the supporting element 14 in the closing position are shown in FIGS. 25 to 27 (and some details are shown in FIGS. 29 and 31) and in FIGS. 44-45.

With reference to the other construction aspects strictly linked to the closing element 32, such as for example its possible constructions variants (air suction means, gas introduction means, film 2 heating means, etc.), these are aspects which are in themselves known to an expert in the sector and, for that reason, will not be described in detail below. Moreover, it should be emphasised that the construction characteristics of the closing element 32 should not be considered as limiting for this invention.

Regarding the contact element 33, several embodiments of which are shown in detail in FIGS. 36 to 39, it provides a contact for the supporting element 14 and supports the supporting element 14 when the closing element 32 and the supporting element 14 are in the closing position.

Figure 36:
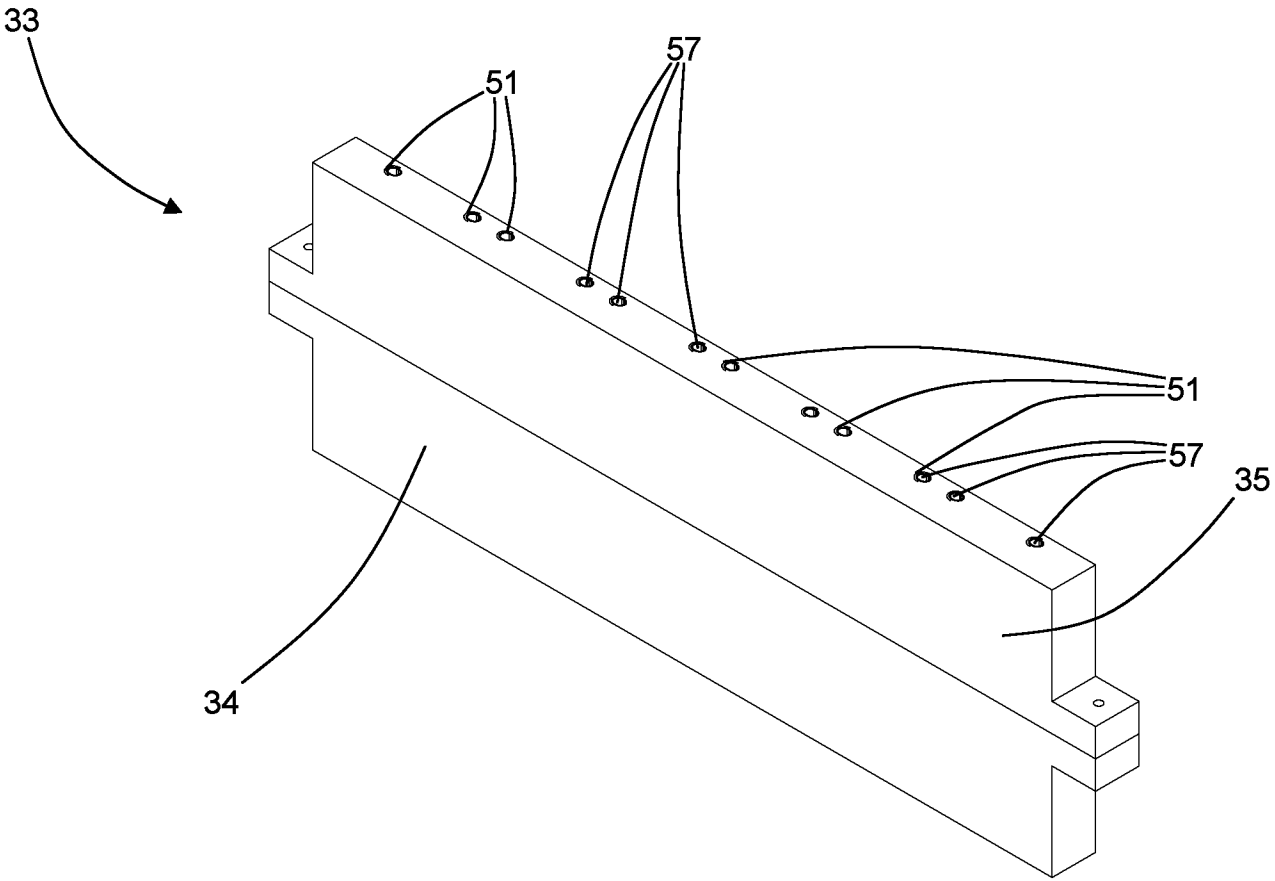
FIG. 36 is an axonometric view of a contact element which is part of the apparatus of FIG. 1.
Figure 37:
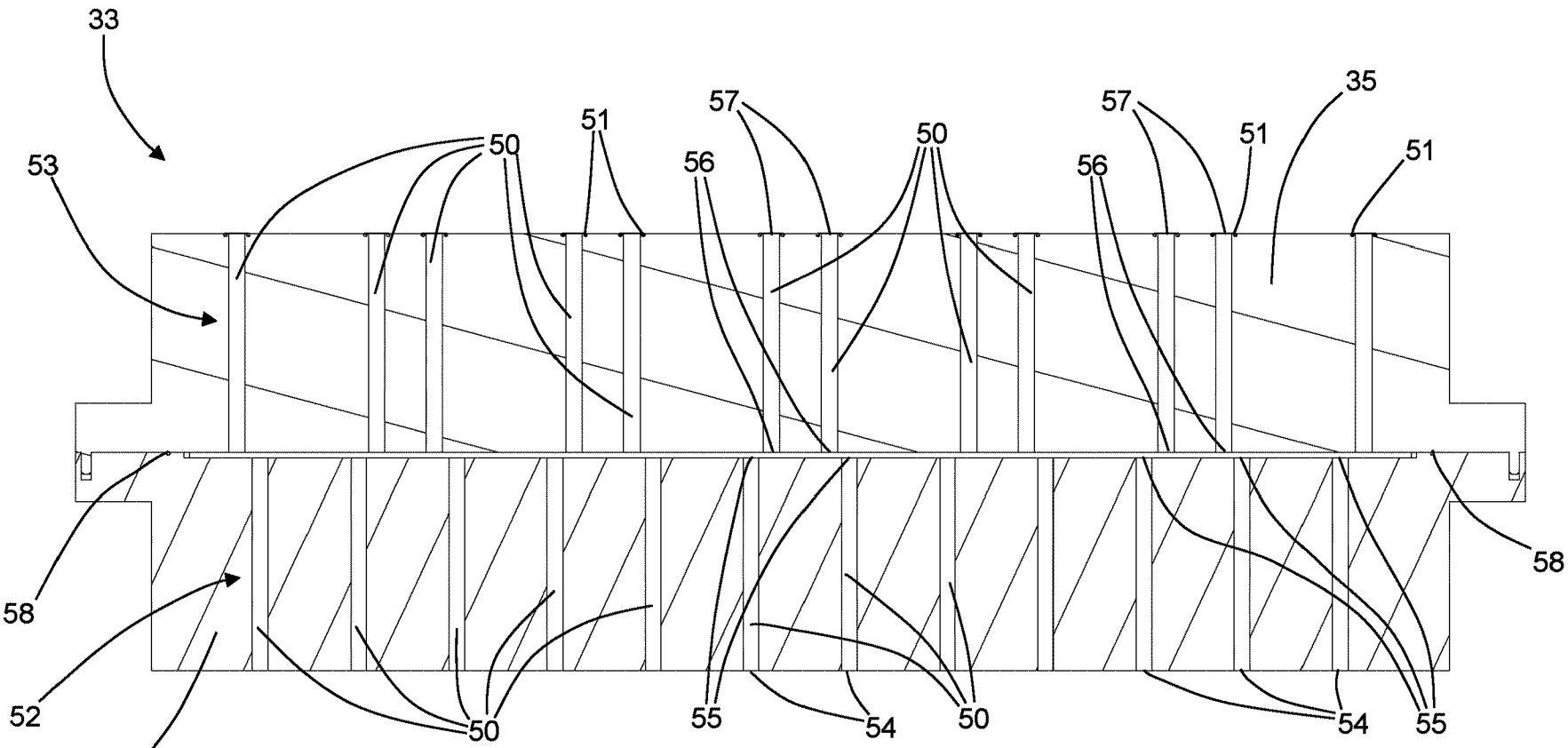
FIG. 37 shows, in a side view vertical section, the contact element of FIG. 36 sectioned according to a longitudinal central plane.

In some embodiments, such as those shown in the accompanying FIGS. 36-37, the contact element 33 comprises a first member 34, which is fixed and stationary relative to the guide 5 (or, more generally, relative to the movement path), and a second member 35, which is associated with the first member 34 and which is interposed between the first member 34 and the closing element 32. In particular, the second member 35 is removably mounted to the first member 34. However, this aspect will be returned to below.

In the preferred embodiments, the apparatus 1 comprises two contact elements 33 which are placed at the application station 6: a first contact element 36 is placed at a first side 37 of the guide 5 (or, more generally, relative to the movement path), whilst a second contact element 38 is placed at a second side 39 of the guide 5 (or, more generally, relative to the movement path), opposite to the first side 37. The presence of two contact elements 33 allows more stable support of a supporting element 14 which is positioned above the guide 5, and which projects laterally relative to the guide 5 (or, more generally, relative to the movement path) both above the first side 37 and above the second side 39: this aspect is clearly visible in the detail shown in FIG. 5 and in the top view of FIG. 4.

Figure 39:
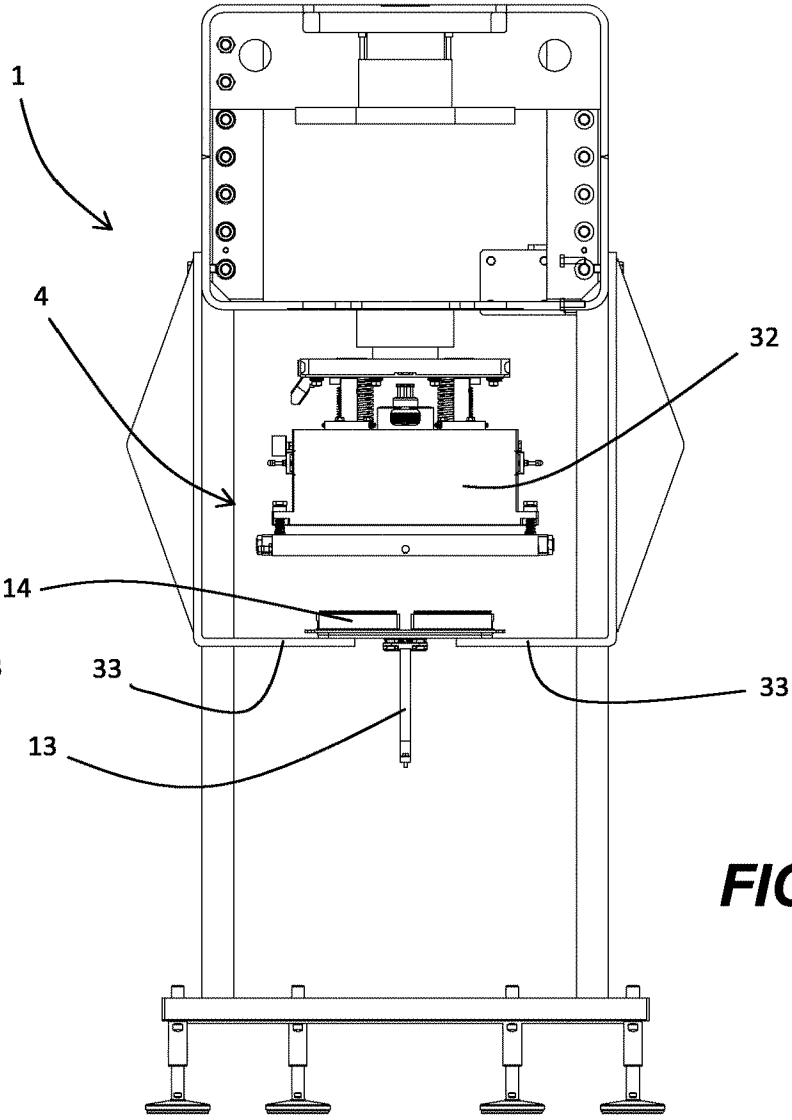
FIG. 39 is a front view with some parts cut away to better illustrate others, of a further embodiment of an apparatus made according to this invention.
Figure 38:
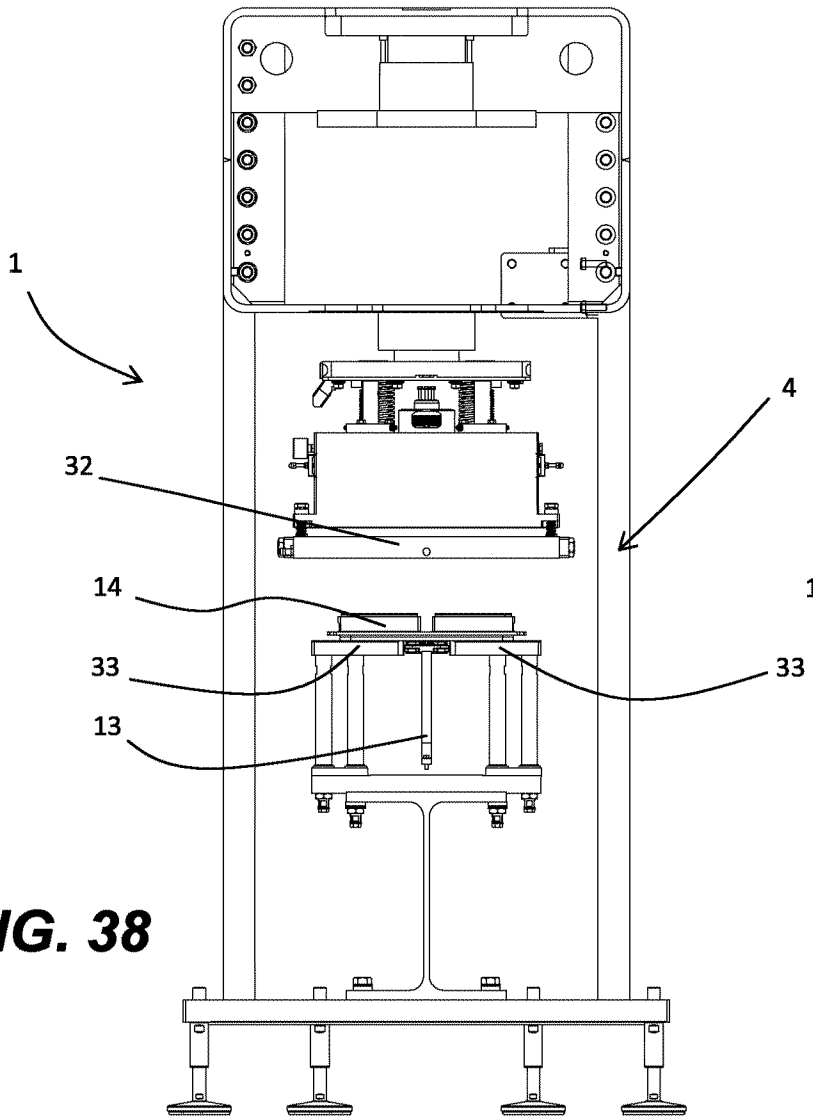
FIG. 38 is a front view with some parts cut away to better illustrate others, of a further embodiment of an apparatus made according to this invention.
Figure 41:
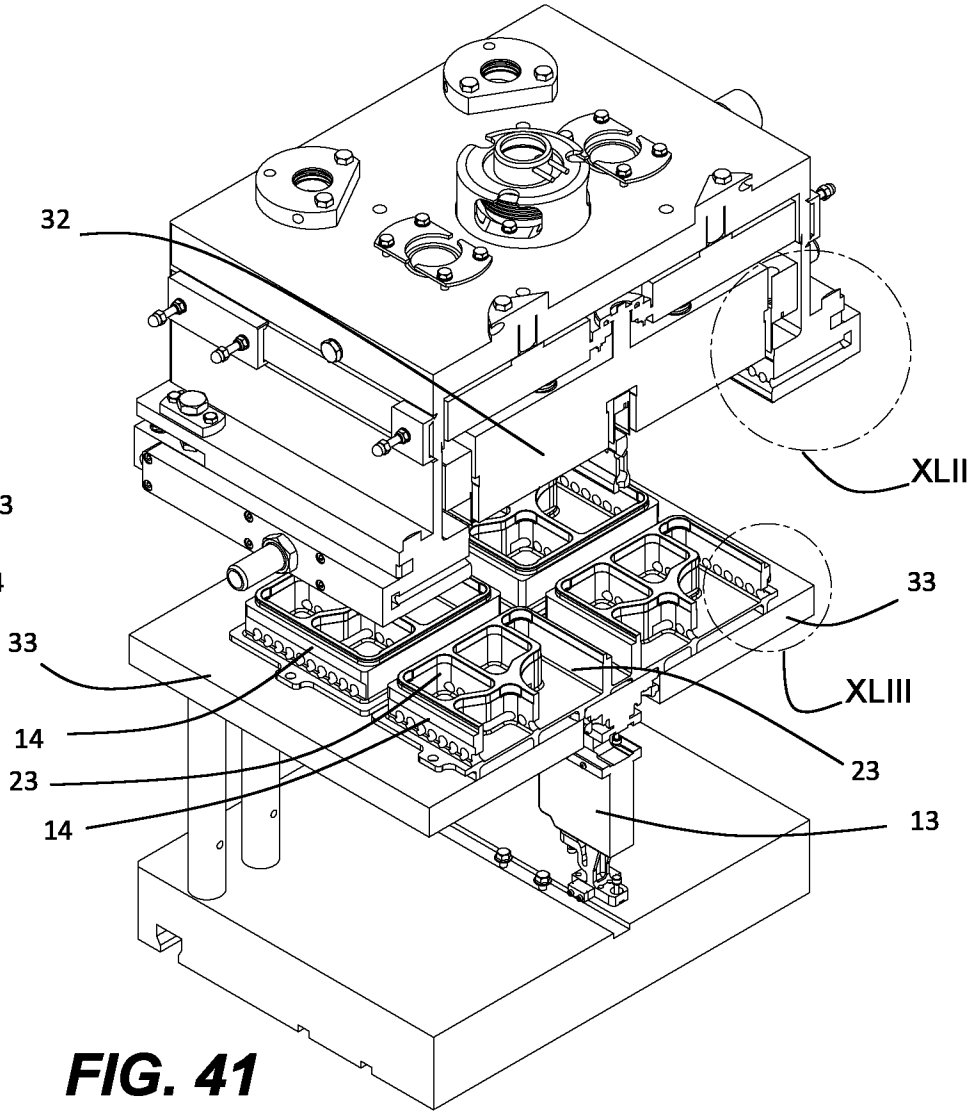
FIG. 41 is a cross-section of the parts of FIG. 40 along a vertical plane.
Figure 40:
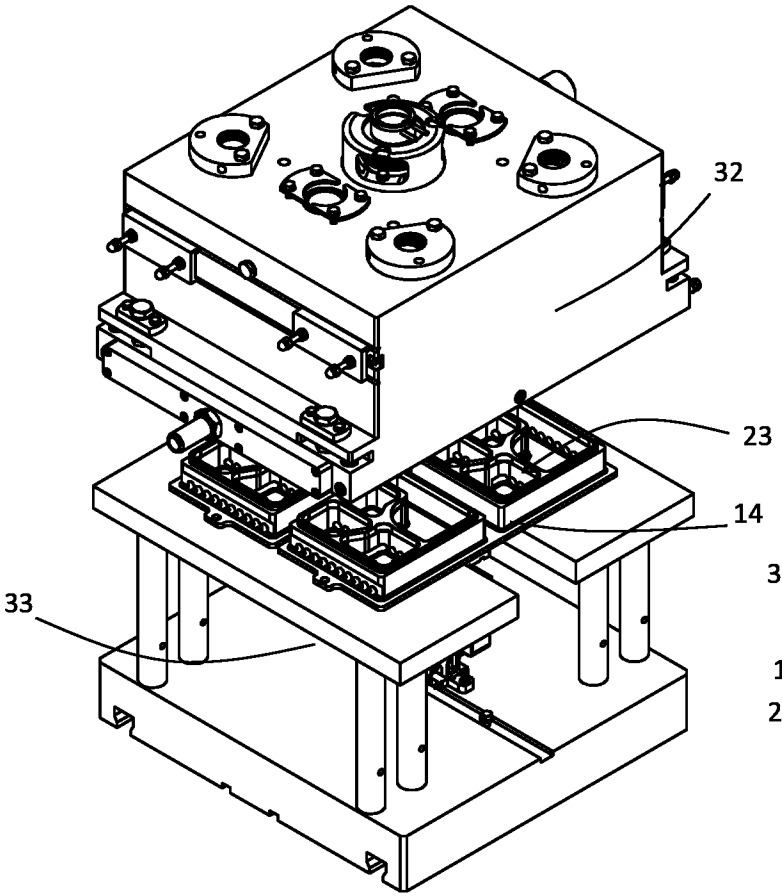
FIG. 40 is an axonometric three-quarter view of several parts of the apparatus of FIG. 38.
Figure 43:
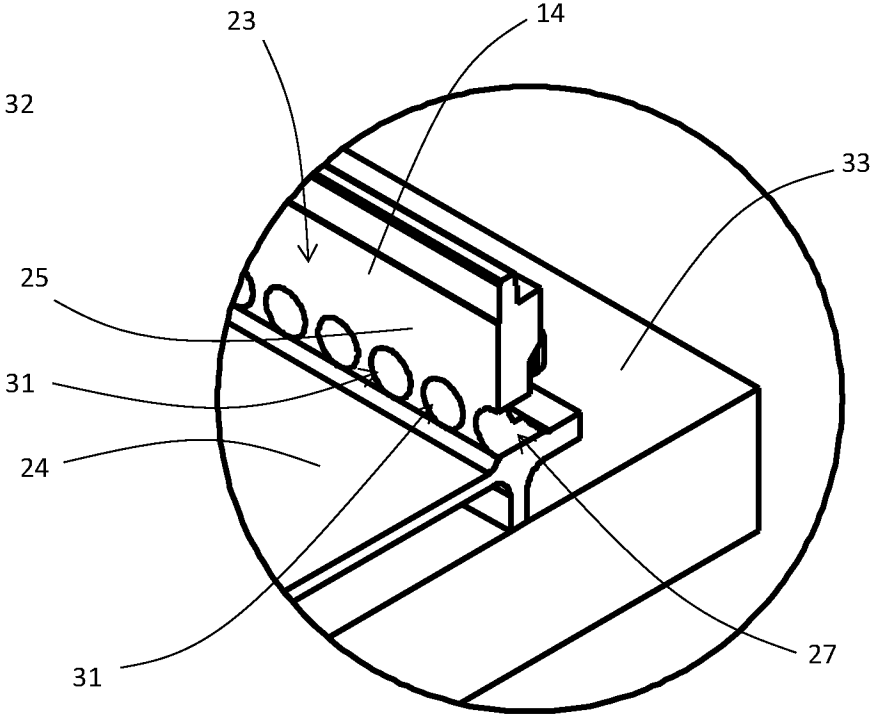
FIG. 43 is an enlarged view of the detail XLIII of FIG. 41.
Figure 42:
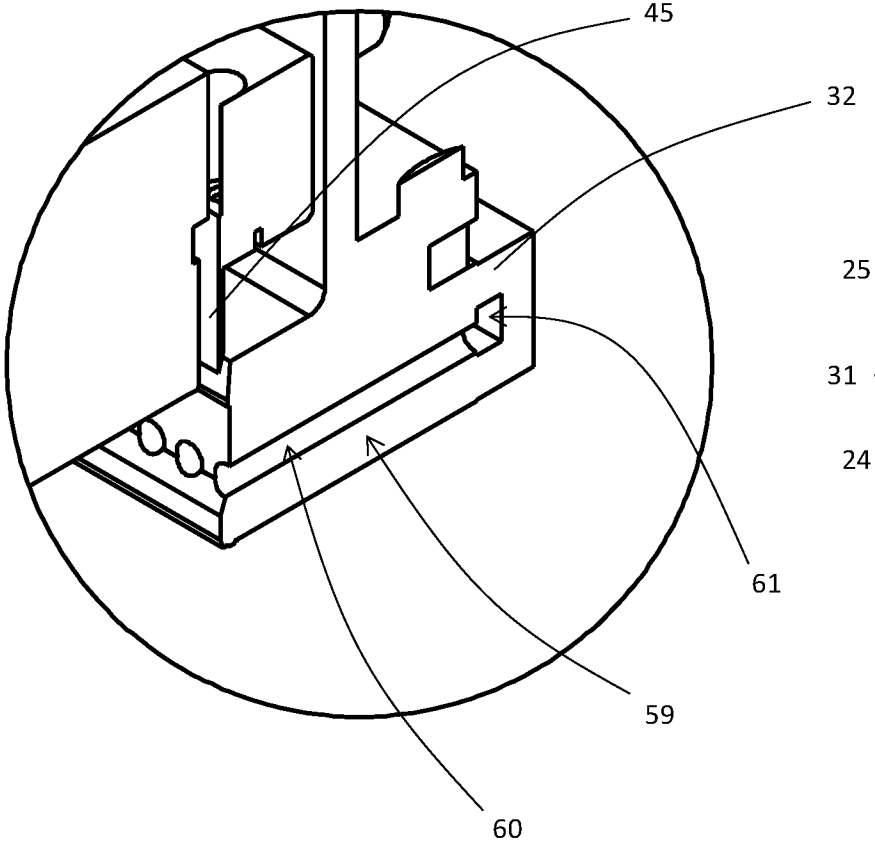
FIG. 42 is an enlarged view of the detail XLII of FIG. 41.

In some embodiments, the contact elements 33, 36, 38 are directly connected to the base of the structure of the apparatus 1 where the guide 5 is also mounted (FIG. 38 in which the guide is not illustrated). In contrast, in other embodiments, the contact elements 33, 36, 38 are connected to the upper part of the structure of the apparatus, the same to which the closing element 32 is connected (FIG. 39).

As already indicated, depending on the embodiments of this invention, the application device 4 may be of different types. For example, it may be selected in the group which comprises: a closing machine; a modified atmosphere sealing machine; a vacuum sealing machine; a skin packaging machine; a thermoforming machine configured to apply, in use, the film 2 to the support 3 by thermoforming of the film 2 on the support 3.

In more detail, in the embodiments in which the application device 4 is configured to apply, in use, the film 2 to the tray, the application device 4 may advantageously be selected in the group which comprises a closing machine, a modified atmosphere sealing machine, a vacuum sealing machine and a skin packaging machine.

When the application device 4 is a closing machine, in some embodiments advantageously, it closes the tray by applying the film 2 (for example sealing it) to the tray at the flange of the tray itself, if the tray has the tub shape described above.

When the application device 4 is a modified atmosphere sealing machine, it is configured to evacuate the air from the housing 23 and to take gas into it, advantageously inert gas, when the closing element 32 and the supporting element 14 are in the closing position. That machine therefore uses MAP (Modified Atmosphere Packaging) technology which is well known to a person who is expert in the sector.

When the application device 4 is a vacuum sealing machine, it is configured to create the vacuum in the housing 23 when the closing element 32 and the supporting element 14 are in the closing position.

When the application device 4 is a skin packaging machine, it uses Skin packaging technology. Therefore, that machine applies the film 2 to the tray, by creating the vacuum inside it, in such a way that the film 2, deforming, completely adheres to the product to be packaged. It should be emphasised that Skin packaging technology is well known to a person who is expert in the sector and its aspects will not be described in further detail.

In the embodiments in which the application device 4, in contrast, is configured to apply, in use, the film 2 to the skeleton, the application device 4 is advantageously a thermoforming machine for applying the film 2 to the skeleton by thermoforming of the film 2 on the skeleton (unless the skeleton is flat). In some of these embodiments, the skeleton may be already formed, and the thermoforming machine thermoforms the film 2 on it. In other embodiments, in contrast the skeleton is to be formed and the thermoforming machine simultaneously forms the skeleton and thermoforms the film 2. As already indicated, the thermoforming machine is advantageously intended to apply a liner (constituted of the film 2) to the skeleton (constituted of the support 3) to obtain a tray.

It should be emphasised that the aspects strictly linked to operation of the various possible types of application devices 4 are in any case known to a person who is expert in the sector and will not be described in further detail, nor are the relative technical details shown in the accompanying figures.

Moreover, preferably, the apparatus 1 comprises positioning means 40 for the film 2, which are configured to position, in use, the film 2 in the application device 4, above the support 3, between the closing element 32 and the supporting element 14, when the supporting element 14 is in the application station 6.

In the embodiments illustrated, the film 2 is obtained from a web 41 wound into a first reel 42 and the positioning means 40 comprise unwinding means 43 for the first reel 42 which comprise a supporting roller 44 for supporting the first reel 42 to be unwound. Moreover, advantageously, the apparatus 1 comprises cutting means 45 for cutting the web 41 unwound from the first reel 42. In some of these embodiments the cutting means 45 are configured to cut the web 41 simultaneously with application of the film 2 to the support 3 by the application device 4. In other embodiments, the cutting means 45 are configured to cut the web 41 before application of the film 2 to the support 3 or after application of the film 2 to the support 3.

In some embodiments, the cutting means 45 are configured to cut the web 41 without interrupting its continuity. Preferably, in this case, the positioning means 40 also comprise a motor-driven roller 46 on which the residual web 48 is wound, into a second reel 47, after cutting. Moreover, the motor-driven roller 46 pulls the web 41 unwinding the first reel 42, in such a way as to position the web 41 from which to obtain the film 2, between the supporting element 14 and the closing element 32, above the supporting element 14 (situation illustrated in FIGS. 1 and 2).

However, alternative embodiments are possible, which are not illustrated, in which the positioning means 40 are configured to feed the film 2 already cut into sheets to the application device 4. In these embodiments, the positioning means 40 position the sheets of film 2 between the supporting element 14 and the closing element 32, above the support 3.

Figure 2:
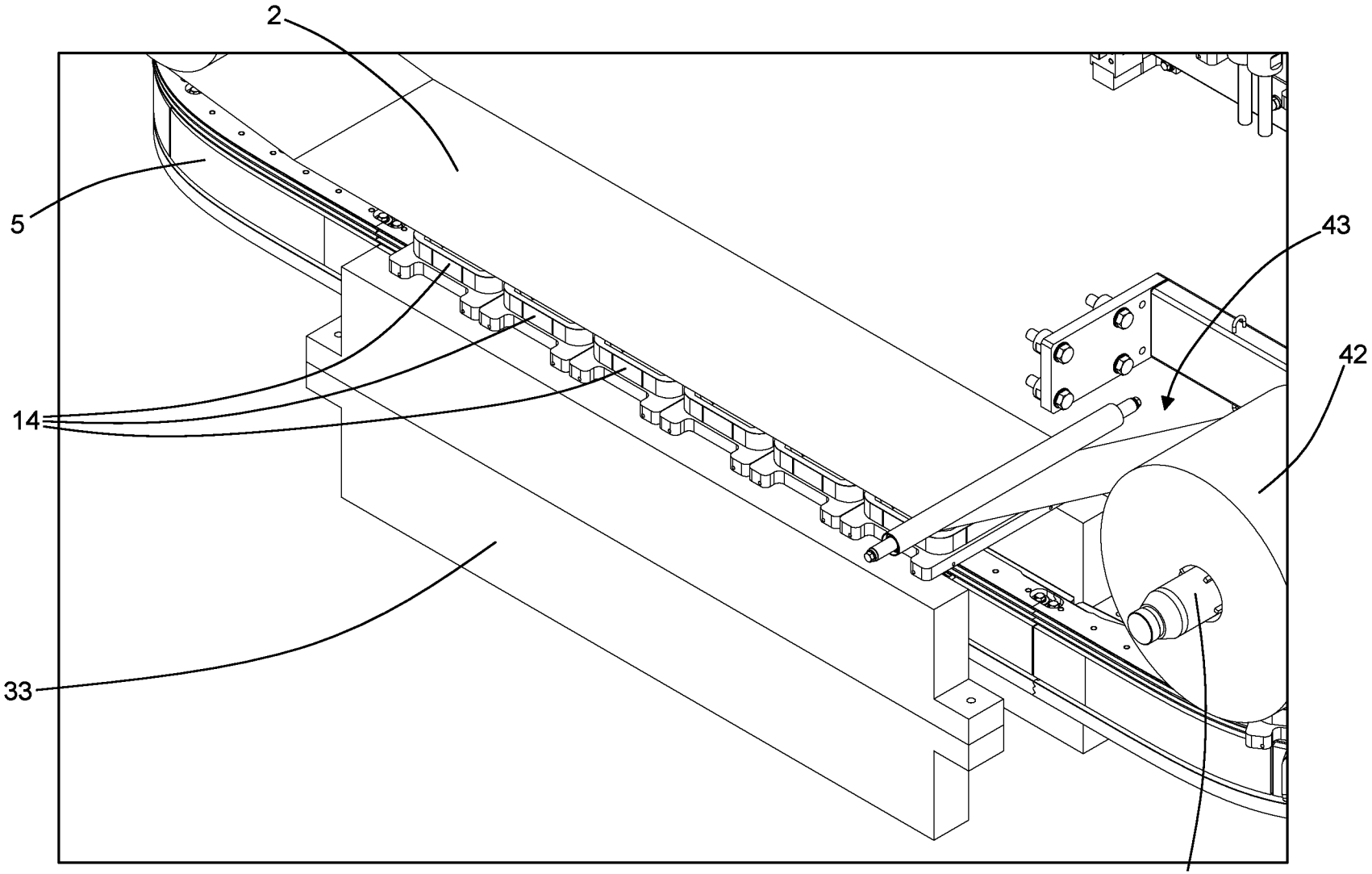
FIG. 2 is an enlarged detail of the apparatus of FIG. 1 with a closing element removed.
Figure 3:
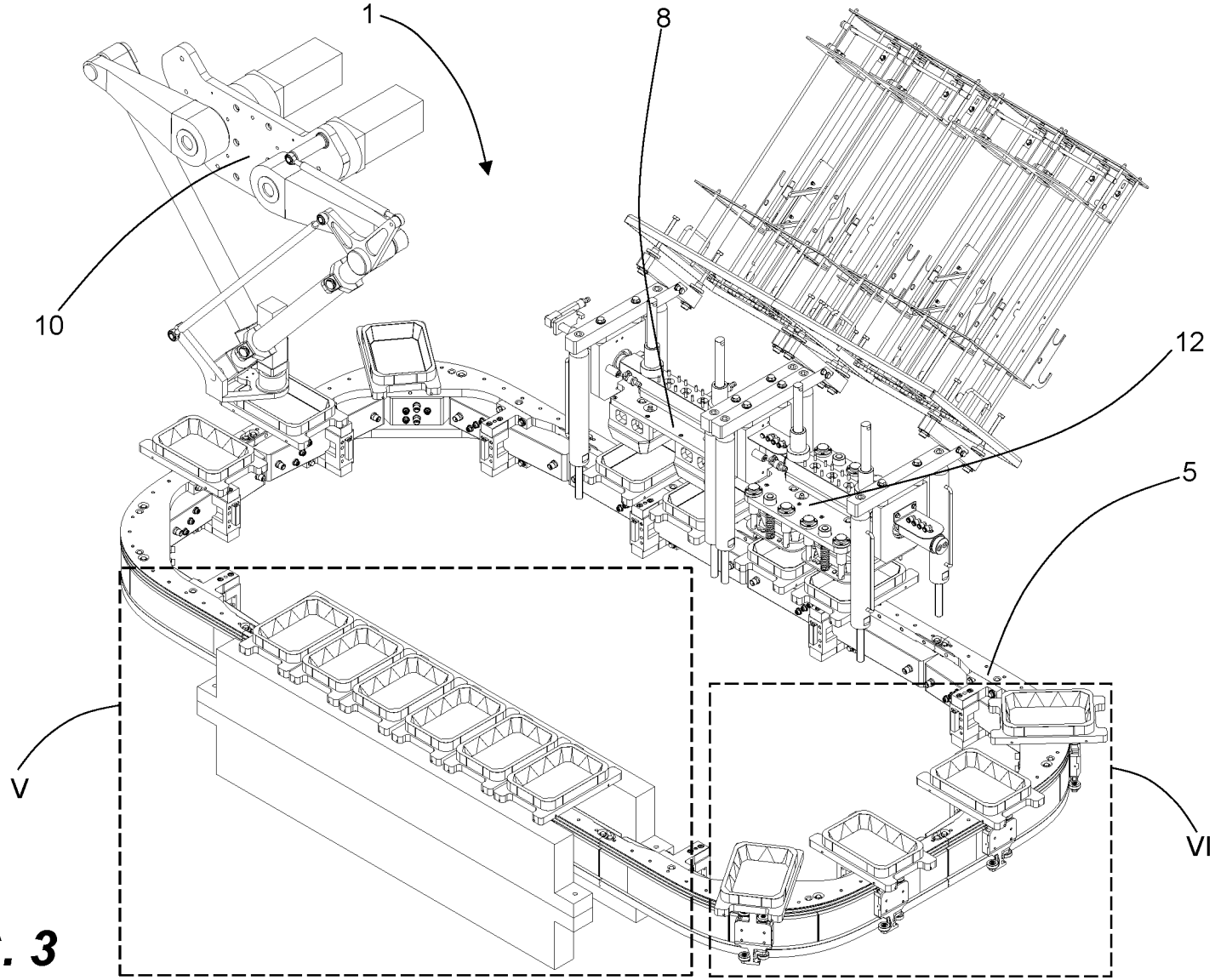
FIG. 3 is an axonometric view of the apparatus of FIG. 1 with some elements removed to better illustrate others.

In the embodiments illustrated, the web 41 is fed to the application device 4 parallel to the stretch of the movement path with which the application station 6 is associated (FIGS. 1 and 2). Alternative embodiments are possible, in which the web 41 is fed to the application device 4 in a different way, for example perpendicularly to the stretch of the movement path with which the application station 6 is associated.

In any case, the aspects which are strictly linked both to the positioning means 40 and to the cutting means 45 are known to a person who is expert in the sector and will not be explained in further detail in the following description.

Advantageously, the apparatus 1 also comprises heating means (not illustrated in the accompanying figures) which are associated with the application device 4 for heating the film 2 to be applied to the support 3. Preferably, the heating means are associated with the closing element 32. In particular, the heating means heat the film 2 advantageously by thermal conduction; for example, the heating means comprise electric heating elements or they define ducts in which a hot fluid flows, both positioned in the closing element 32. Similarly to what was indicated above both for the positioning means 40 and for the cutting means 45, the aspects strictly linked to the heating means, being known to a person who is expert in the sector, will also not be explained in further detail in the following description and the expert will be capable of selecting the type of heating means best suited to the specific application device 4.

In some embodiments, when the supporting element 14 is in the application station 6, the supporting element 14 is always in contact with the contact element 33. In other words, when the supporting element 14 reaches the application station 6, the supporting element 14 slides on the contact element 33 thereby remaining in contact with it. In particular, the supporting element 14 is in contact with the contact element 33 when the closing element 32 and the supporting element 14 are in the opening position.

In contrast, in other embodiments, when the supporting element 14 reaches the application station 6, the supporting element 14 is spaced apart from the contact element 33.

In some embodiments, the supporting element 14 remains stationary relative to the movement element 13.

However, in accordance with a second innovative aspect of this invention, the supporting element 14 is advantageously movable relative to the movement element 13 between a non-operating position and an operating position. In the preferred embodiments, in particular, the movement of the supporting element 14 relative to the movement element 13, between the non-operating position and the operating position, is caused either by a movement of the closing element 32 or by a movement of the contact element 33 or by a movement of both the closing element 32 and of the contact element 33 or by the interaction of the supporting element 14 with the closing element 32 and/or with the contact element 33 (for example the supporting element may go up on the contact element 33 rising relative to the movement element 13). In contrast, in other embodiments, the movement of the supporting element 14 between the non-operating position and the operating position is caused by a different element, such as for example an actuator which is mounted between the supporting element 14 and the movement element 13.

Advantageously, the supporting element 14 is in the non-operating position when the closing element 32 and the supporting element 14 are in the opening position (FIGS. 22 to 24). In contrast, the supporting element 14 is advantageously in the operating position when the closing element 32 and the supporting element 14 are in the closing position (FIGS. 25 to 27).

In the embodiments in which the movement of the supporting element 14 relative to the movement element 13 is caused by a movement of the closing element 32 and/or of the contact element 33, advantageously, as already indicated, the apparatus 1 comprises the elastic element 21 mounted between the supporting element 14 and the movement element 13. That elastic element 21 is elastically switchable between a first configuration and a second configuration. The elastic element 21 is in the first configuration when the supporting element 14 is in the non-operating position (and, therefore, also when the closing element 32 and the supporting element 14 are in the opening position). In contrast, the elastic element 21 is in the second configuration when the supporting element 14 is in the operating position (and, therefore, advantageously when the closing element 32 and the supporting element 14 are in the closing position). In particular, the movement of the supporting element 14 between the non-operating position and the operating position causes the elastic switching of the elastic element 21, respectively between the first configuration and the second configuration. In the embodiments illustrated, the elastic element 21 comprises, or is constituted of, a compression spring which is substantially vertical and which preferably extends from an end coupled to the supporting element 14, to an end coupled to the movement element 13.

Advantageously, the apparatus 1 comprises a plurality of elastic elements 21 (compression springs in the accompanying figures) which are mounted between the supporting element 14 and the movement element 13, each of which is elastically switchable between the first configuration and the second configuration. In particular, in the embodiments illustrated, the apparatus 1 comprises four elastic elements 21 (four compression springs) which are spaced apart from each other and which are placed at vertices of a rectangle. In accordance with a first type of embodiments, the elastic switching of the elastic elements 21 from the first configuration to the second configuration occurs by compression of the elastic elements 21.

In accordance with a second type of embodiments, the elastic switching of the elastic elements 21 from the first configuration to the second configuration occurs by extension of the elastic elements 21.

Regarding the first type, in some of these embodiments (such as those shown in the figures) the contact element 33 is fixed and stationary relative to the guide 5 and the closing element 32 is movable relative to the guide 5. During the movement from the opening position towards the closing position, the closing element 32 and the supporting element 14 assume an intermediate position, in which the closing element 32 and the supporting element 14 are coupled to each other but the supporting element 14 is spaced apart from the contact element 33. During the movement from the opening position to the intermediate position, the supporting element 14 remains stationary relative to the movement element 13 and the closing element 32 moves towards the supporting element 14. During the subsequent movement from the intermediate position to the closing position, the closing element 32 and the supporting element 14 move together with each other as one, with the supporting element 14 being moved by the closing element 32 towards the movement element 13, until the supporting element 14 rests on the contact element 33 reaching the closing position in which it is clamped between the closing element 32 and the contact element 33.

In other embodiments belonging to the first type, not illustrated in the accompanying figures, the contact element 33 is also movable relative to the guide 5, between a home position and a working position. When the contact element 33 is in the working position, that contact element 33 provides a contact for the supporting element 14 and supports the supporting element 14 when the closing element 32 and the supporting element 14 are in the closing position.

However, in this case two different solutions are possible, a first solution in which when the contact element 33 reaches the working position, the contact element 33 is not in contact with the supporting element 14, and a second solution in which when the contact element 33 reaches the working position, in contrast the contact element 33 is in contact with the supporting element 14.

In the case of the first solution, similarly to what was previously described, the closing element 32 and the supporting element 14 assume the intermediate position during the movement from the opening position towards the closing position. Moreover, even what was described with reference to the movement from the opening position to the intermediate position and from the intermediate position to the closing position is similar to what was described above. In particular, in some of these embodiments the contact element 33 is movable from the home position to the working position during the movement from the opening position to the intermediate position; in others of these embodiments, the contact element 33 is movable from the home position to the working position during the movement of the closing element 32 and of the supporting element 14 from the intermediate position to the closing position; in contrast, in yet others of these embodiments, the contact element 33 is movable from the home position to the working position during the entire movement of at least one of the closing element 32 and the supporting element 14 from the opening position to the closing position.

In the case of the second solution too, the closing element 32 and the supporting element 14 assume the intermediate position during the movement from the opening position towards the closing position, and what is described with reference to the movement from the opening position to the intermediate position and from the intermediate position to the closing position is similar to what was described for the first solution. However, in the second solution the movement of the closing element 32 (and of the supporting element 14) is coordinated with the movement of the contact element 14 in such a way that, when the contact element 33 reaches the working position, the closing element 32 and the supporting element reach the closing position and the contact element 33 is in contact with the supporting element 14.

It should be emphasised that in all of these embodiments of the first type, in which the contact element 33 is movable relative to the guide 5 and in which the closing element 32 and the supporting element 14 assume the intermediate position during the movement from the opening position to the closing position, the contact element 33 is spaced apart from the supporting element 14 when the closing element 32 and that same supporting element 14 reach the intermediate position, whilst the contact element 33 is coupled to the supporting element 14 when the closing element 32 and that same supporting element 14 are in the closing position (and the contact element 33 is in the working position).

In the embodiments described above, advantageously, during the movement from the intermediate position to the closing position, the elastic element 21 elastically switches its configuration from the first configuration to the second configuration.

In particular, in this first type, both in the embodiments in which the contact element 33 is fixed and stationary relative to the guide 5, and in the embodiments in which the contact element 33 is also movable relative to the guide 5 between the home position and the working position and in which it is spaced apart from the supporting element 14 when the closing element 32 and that same supporting element 14 are in the intermediate position (both regarding the first solution, and regarding the second solution), the elastic switching of the elastic element 21 between the first configuration and the second configuration corresponds to a compression of the elastic element 21. In more detail, if the elastic element 21 comprises the compression spring, the first configuration (FIGS. 28 and 30) is a home or compressed configuration (in the case of a prestressed spring) of the compression spring, whilst the second configuration (FIGS. 29 and 31) is a (more) compressed configuration of the compression spring than the first configuration.

In the embodiments of the first type, during the movement from the closing position to the opening position, the closing element 32 and the supporting element 14 assume the intermediate position described above. In the preferred embodiments, the closing element 32 is moved away from the movement element 13. During the movement from the closing position to the intermediate position, the closing element 32 and the supporting element 14 move together with each other as one, with the supporting element 14 which is held in contact with the closing element 32 and which is moved, away from the movement element 13, by the elastic element 21. During this movement, the elastic element 21 switches its elastic configuration from the second configuration to the first configuration (in the preferred embodiments in which the elastic element 21 is a compression spring, as previously described, the compression spring extends): the switching from the second configuration to the first configuration moves the supporting element 14 as described. During the subsequent movement from the intermediate position to the opening position, the supporting element 14 remains stationary relative to the movement element 13, since the elastic element 21 has already assumed the second configuration, and the closing element 32 moves away from the supporting element 14 until the opening position is reached.

If the contact element 33 is also movable, advantageously it will move from the working position to the home position in the opposite way to what is described above.

Passing to the embodiments of the second type, in which the elastic elements 21 extend by elastically switching from the first configuration to the second configuration, the contact element 33 is movable relative to the guide 5 between the home position and the working position. During the movement of the contact element 33 from the home position to the working position, the contact element 33 assumes a transit position, in which the contact element 33 and the supporting element 14 are coupled to each other and the supporting element 14 is spaced apart from the closing element 32. During the movement from the home position to the transit position, the supporting element 14 remains stationary relative to the movement element 13 and the contact element 33 moves towards the supporting element 14. The contact element 33 and the supporting element 14 make contact when the contact element 33 reaches the transit position. During the subsequent movement from the transit position to the working position, the contact element 33 and the supporting element 14 move together with each other as one, with the supporting element 14 being moved by the contact element 33 away from the movement element 13.

In these embodiments it is possible either that the closing element 32 remains stationary, or that it too moves towards the supporting element 14. In the latter case, it may be the case that the closing element 32 moves only during the movement from the home position to the transit position, or that the closing element 32 moves towards the supporting element 14 only during the movement from the transit position to the working position, or that the closing element 32 moves towards the supporting element 14 during the entire movement from the home position to the working position.

Advantageously, during the movement of the contact element 33 from the transit position to the working position, the elastic element 21 elastically switches its configuration from the first configuration to the second configuration.

In particular, the elastic switching of the elastic element 21 between the first configuration and the second configuration corresponds to an extension of the elastic element 21. In more detail, if the elastic element 21 comprises a compression spring, the first configuration is a home or extended configuration (in the case of a prestressed spring) of the compression spring, whilst the second configuration is a (more) extended configuration of the compression spring than the first configuration.

In these embodiments, during the opposite movement of the contact element 33 from the working position to the transit position, the contact element 33 and the supporting element 14 move together with each other as one, with the supporting element 14 which is held in contact with the contact element 33 and which is moved, towards the movement element 13, by the elastic element 21. During this movement, the elastic element 21 switches its elastic configuration from the second configuration to the first configuration (in the preferred embodiments in which the elastic element 21 is a compression spring, as previously described, the compression spring reduces its extension): the switching from the second configuration to the first configuration moves the supporting element 14. During the subsequent movement from the transit position to the home position, the supporting element 14 remains stationary relative to the movement element 13, since the elastic element 21 has already assumed the second configuration, and the contact element 33 moves away from the supporting element 14 until the home position is reached.

The second type also includes embodiments in which the supporting element 14 moves away from the movement element 13 due to an interaction with the contact element 33, for example if the supporting element 14 goes up on the contact element 33 while it reaches the application station 6. That result may be achieved for example by ensuring that upstream of the application station 6, the contact element has an upper surface with an inclined plane.

As already indicated, embodiments are also possible in which the supporting element 14 is stationary relative to the movement element 13. However, in that case too it is possible that the contact element 33 moves between the home position and the working position in a way coordinated with the movement of the closing element 32 between the opening position and the closing position.

In particular, in some of these embodiments the contact element 33 is movable towards the supporting element 14 until it couples to the supporting element 14 without moving it and the closing element 32 is movable towards the supporting element 14 until the closing position of the supporting element 14 and of the closing element 32 is reached. In more detail, it is possible that the closing element 32 moves towards the supporting element 14 during the movement of the contact element 33 from the home position to the working position or after the movement of the contact element 33 (that is to say, when the contact element 33 is already coupled to the supporting element 14); it is also possible that the contact element 33 moves after the closing position has been reached by the closing element 32 and by the supporting element 14 (that is to say, when the closing element 32 is already coupled to the supporting element 14).

Figure 44:
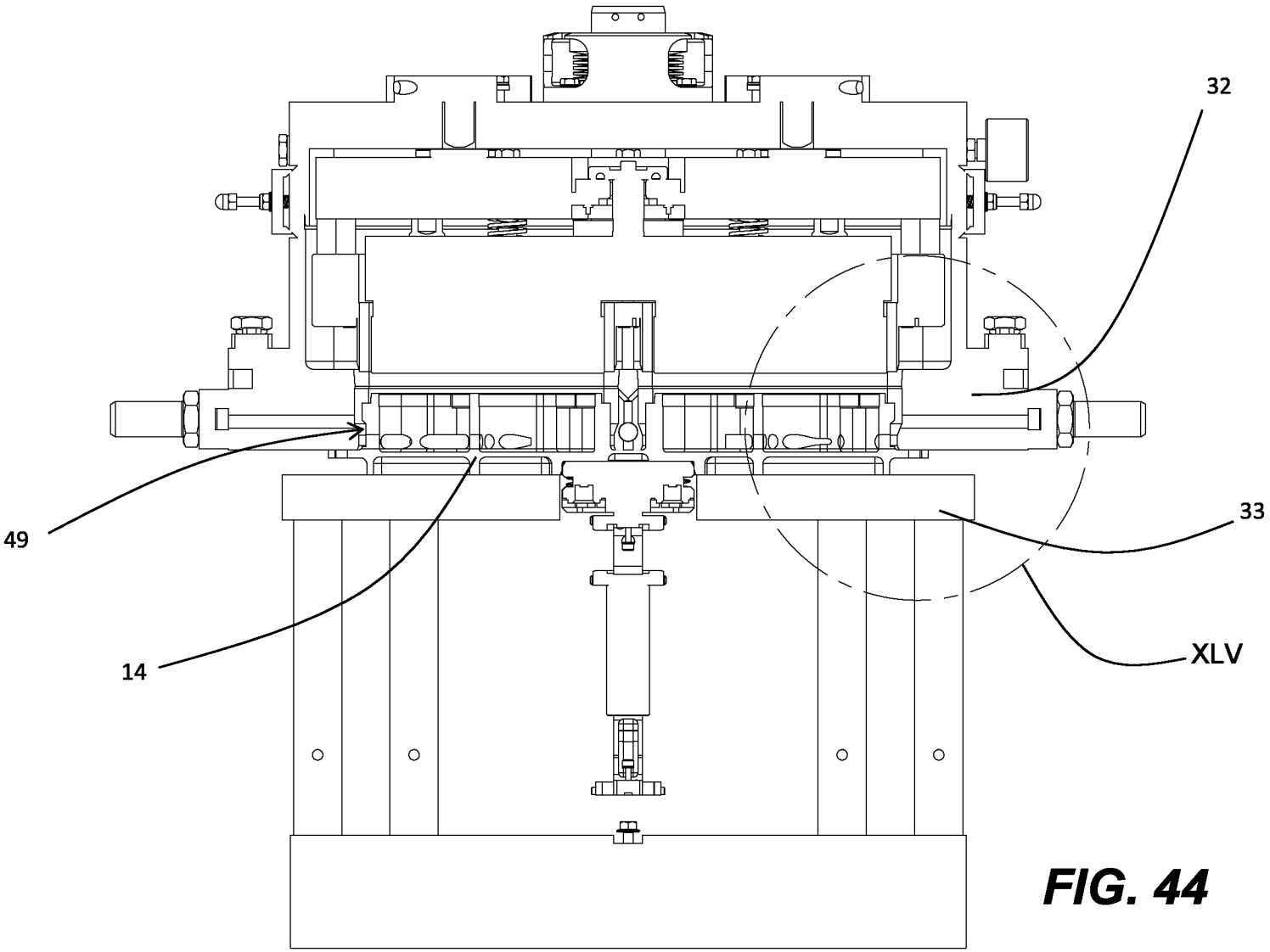
FIG. 44 is a front view of the parts of FIG. 41.
Figure 45:
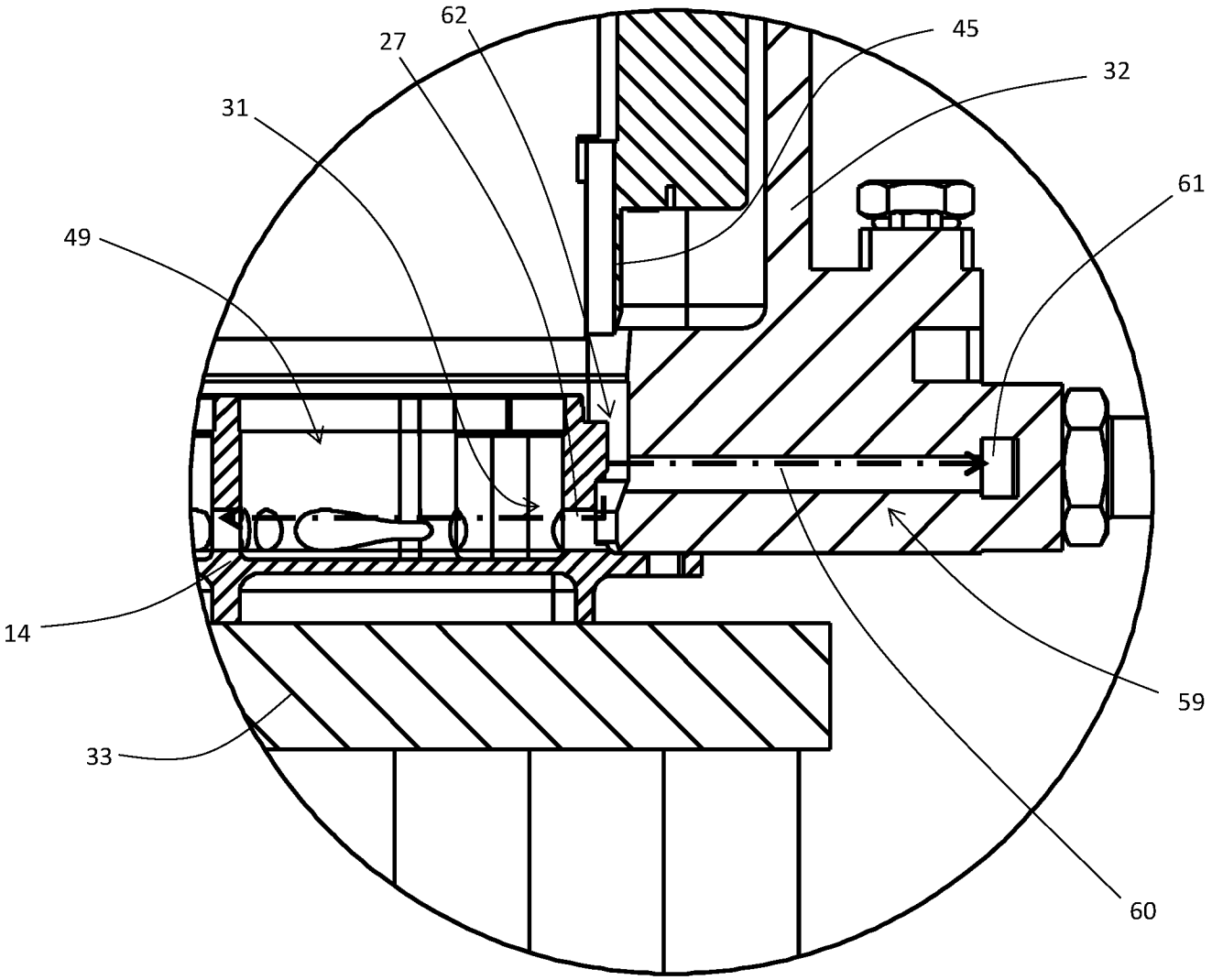
FIG. 45 is an enlarged view of the detail 45 of FIG. 44.

In accordance with a further aspect of this invention, when the closing element 32 and the supporting element 14 are in the closing position, the closing element 32 and the supporting element 14 are coupled to each other in a fluid-tight manner relative to the outside and they jointly delimit an application chamber 49. That means that, when the closing element 32 and the supporting element 14 are in the closing position, the closing element 32 abuts against the supporting element 14 preventing, for example by means of suitable first gasket means placed between the closing element 32 and the supporting element 14, fluid communication between the application chamber 49 and the outside (FIG. 44). It should be emphasised that the expression "are coupled to each other in a fluid-tight manner relative to the outside" means that, when the closing element 32 and the supporting element 14 are in the closing position, there is no fluid communication between the application chamber 49 and the outside at the coupling zones between the closing element 32 and the supporting element 14 (in other words, the zones of contact between the two elements); however, it is possible that the application chamber 49 is in communication with the outside through the first ducts 27 made in the supporting element 14.

In the embodiments in which the application device 4 involves a modification of the environment inside the application chamber 49 (pressure, type of gas, etc.), ducts are made both in the supporting element 14 and in the contact element 33. In particular, as already indicated, made in the supporting element 14 are the first ducts 27 which are in fluid communication with the housing 23 and, if necessary, with each other.

According to several embodiments such as those illustrated in FIGS. 1 to 37, made in the contact element 33 there is a plurality of second ducts 50 which are connected respectively to a suction device and/or to an intake device (neither the suction device nor the intake device are shown in the figures).

Advantageously, when the supporting element 14 is coupled to the contact element 33 (in particular when the supporting element 14 and the closing element 32 are located in the closing position), the first ducts 27 and the second ducts 50 are in fluid communication with each other and, in this way, respectively the suction device is connected to the application chamber 49 to suck air from the application chamber 49 and/or the intake device is connected to the application chamber 49 to take gas into the application chamber 49. In particular, the first ducts 27 and the second ducts 50 are connected to each other at respective ends which are directed one set (the ends of the first ducts 27) towards the other set (the ends of the second ducts 50). In more detail, as is clearly visible in FIGS. 35 to 37, at the interface zones between the first ducts 27 and the second ducts 50 there are second gaskets 51 present to prevent fluid communication between the first ducts 27 and the outside and between the second ducts 50 and the outside at those interface zones. Advantageously, the interface zones correspond to zones of contact between the supporting element 14 and the contact element 33. The second gaskets 51 are preferably associated with one of either the supporting element 14 or the contact element 33.

In the preferred embodiments illustrated in the accompanying figures, as briefly referred to above, the contact element 33 comprises the first member 34 and the second member 35, with the first member 34 being fixed and stationary relative to the guide 5 and with the second member 35 being removably coupled to the first member 34 and interposed between the first member 34 and the closing element 32. Advantageously, a first group 52 of second ducts 50 is made in the first member 34, whilst a second group 53 of second ducts 50 is made in the second member 35. The first group 52 of second ducts 50 is in fluid communication with the second group 53 of second ducts 50, is connected respectively to the suction device and/or to the intake device and is interposed between the second group 53 of second ducts 50 and the suction device and/or the intake device.

When the contact element 33 and the supporting element 14 are coupled to each other, the second group 53 of second ducts 50 is in turn in fluid communication with the first ducts 27 (which are made in the first member 34). For example, in the embodiments in which the application device 4 is one of either the vacuum packaging machine, the skin packaging machine or the thermoforming machine, the first group 52 of second ducts 50 is advantageously connected only to the suction device. In the embodiments in which the application device 4 is the machine for packaging in a modified atmosphere, the first group 52 of second ducts 50 is advantageously connected both to the suction device and to the intake device.

In the embodiments illustrated, the first group 52 of second ducts 50 comprises a plurality of vertical second ducts 50 (in particular, twelve vertical second ducts 50), each of which advantageously extends from a first end 54 to a second end 55, and a horizontal second duct 50 which puts the vertical second ducts 50 in fluid communication with each other. In more detail, the vertical second ducts 50 are in fluid communication with the horizontal second duct 50 through the respective second ends 55 whilst they are advantageously connected to the suction device and/or to the intake device through the respective first ends 54. Moreover, the second group 53 of second ducts 50 too comprises a plurality of vertical second ducts 50 (again, in particular, twelve vertical second ducts 50), each of which advantageously extends from a third end 56 to a fourth end 57. As already indicated, the first group 52 of second ducts 50 and the second group 53 of second ducts 50 are in fluid communication with each other. In particular, the second group 53 of second ducts 50 is in fluid communication with the horizontal second duct 50 of the first group 52 of second ducts 50. In more detail, the second ducts 50 of the second group 53 are in fluid communication with the horizontal second duct 50 of the first group 52 of second ducts 50, at the respective third ends 56, whilst the second ducts 50 of the second group 53 are advantageously in fluid communication with the first ducts 27 through the respective fourth ends 57.

Advantageously, placed between the first member 34 and the second member 35 there is at least one third gasket 58, in such a way as to guarantee, between the two members 34, 35, a coupling with fluid-tight seal relative to the outside, so that the first group 52 of second ducts 50 and the second group 53 of second ducts 50 are not in fluid communication with the outside at the coupling zone between the first member 34 and the second member 35. In the embodiments illustrated, only one third gasket 58 is present, which surrounds the horizontal second duct 50 (described above) of the first group 52 of second ducts 52. However different embodiments are possible, in which the first group 52 of second ducts 50 and/or the second group 53 of second ducts 50 have a different number and/or arrangement of second ducts 50 (and consequently of any third gaskets 58 placed between the first member 34 and the second member 35).

What was just described concerning the structure of the contact element 33 is particularly advantageous if the apparatus 1 is intended to operate on supports 3 whose shape and/or size may be different at different moments, that is to say, it is suitable for size change-overs.

In fact, in the preferred embodiments, the apparatus 1 comprises a supporting element 14 of a first type and a second member 35 of a first type, with the second member 35 of the first type being configured to couple to the supporting element 14 of the first type; moreover, the apparatus 1 comprises a supporting element 14 of a second type and a second member 35 of a second type, with the second member 35 of the second type being configured to couple to the supporting element 14 of the second type.

The supporting elements 14 of the two types are interchangeably mountable on the same movement element 13, in such a way as to adapt the apparatus 1 for processing different types of supports 3. Each of them will advantageously be provided with first ducts 27 with different arrangements, suitable for the support 3 to be processed. Consequently, the ends of the first ducts 27 which are located at the interface zones, may be positioned differently relative to the contact element 33 when the supporting element 14 is in the application station 6.

In turn, made in the second member 35 of the first type and in the second member 35 of the second type there are, respectively, second ducts 50 of the second group 53 of second ducts 50 which extend in such a way as to couple to the second ducts 50 of the first group 52 of second ducts 50, on one side, and to the first ducts 27 made in the relative supporting element 14, on the other side.

Moreover, advantageously, the second member 35 of the first type and the second member 35 of the second type are removably couplable to the first member 34 in such a way that they are interchangeable with each other. In other words, the second member 35 is removably mounted on the first member 34 in such a way that one second member 35 (for example that of the first type) which is suitable for one supporting element 14 (for example that of the first type), is interchangeable with another second member 35 (for example that of the second type) which is suitable for another supporting element 14 (for example that of the second type).

In the embodiments illustrated, the interchangeability between the various second members 35 is facilitated by the presence of the horizontal second duct 50.

However, in general, the same apparatus 1 will be able to comprise any number of types of supporting elements 14 and of corresponding second members 35 of the contact element 33.

According to alternative embodiments, such as those illustrated in FIGS. 40 to 45, there is no second duct 50 made in the contact element 33, whilst a plurality of third ducts 59 is made in the closing element. The third ducts 59 are connected respectively to the suction device and/or to the intake device. Moreover, when the supporting element 14 and the closing element 32 are in the closing position, the first ducts 27 are in fluid communication with the third ducts 59 and, respectively, the suction device and/or the intake device is connected to the application chamber 49 for, respectively, sucking air from the application chamber 49 and/or taking gas into the application chamber 49, through the third ducts 59 and the first ducts 27. In the embodiment illustrated the third ducts 59 comprise a plurality of end ducts 60 which extend starting from manifold ducts 61 as far as the inside of the application chamber 49. Moreover, advantageously, when the application chamber 49 is closed, between the closing element 32 and the supporting element 14 an empty space 62 remains which acts as a connection between the first ducts 27 and the third ducts 59. In FIG. 49 the route of the airflows in and out of the housing 23 is shown by the thick dash-dotted line.

Essentially, the apparatus 1 according to this invention allows the possibility of performing a size change-over in such a way as to be able to apply the film 2 to supports 3 of a different type (which require supporting elements 14 of a different type). Therefore, the size change-over is performed by simply substituting the supporting element 14 and, if necessary, either the second member 35 of the contact element 33 or the closing element 32 and that makes that operation very quick. In fact, when a size change-over has to be performed, for example to change from one support 3 suitable for being housed in the housing 23 defined by the supporting element 14 shown in FIGS. 7 to 14 (first type), to a support 3 suitable for being housed in the housing 23 defined by the supporting element 14 shown in FIGS. 15 to 18 (second type), on one hand the supporting element 14 of the first type is substituted with that of the second type, and on the other hand either a second member 35 of a first type suitable for the supporting element 14 of the first type is substituted with a second member 35 of a second type suitable for the supporting element 14 of the second type, or a closing element 32 of a first type suitable for the supporting element 14 of the first type is substituted with a closing element 32 of a second type suitable for the supporting element 14 of the second type.

In the embodiments illustrated in the accompanying figures, the apparatus 1 comprises a plurality of movement elements 13 and a plurality of supporting elements 14. Advantageously, the movement elements 13 are slidably associated with the guide 5, are movable one after another along the movement path and are moved, in use, along the movement path by the linear motors of the guide 5.

In contrast, regarding the supporting elements 14, each of them is coupled to a movement element 13 and is movable with this movement element 13 along the movement path. Moreover, each supporting element 14 defines at least one housing 23 for housing, in use, a support 3.

Moreover, the application device 4 preferably comprises both those supporting elements 14 when they are placed at the application station 6, and a closing element 32 for each supporting element 14 placed in the application station 6. Each closing element 32 is configured to associate, in use, with a supporting element 14 when the supporting element 14 is placed at the application station 6, below that closing element 32. The supporting elements 14 are interposed between the closing elements 32 and the contact element 33, when they are at the application station 6.

In the embodiment shown in FIGS. 1 to 6, at the application station 6 there are six supporting elements 14 simultaneously present and the application device 4 comprises six closing elements 32 (which are substantially associated in a single body).

An embodiment of this type allows an apparatus with high productivity to be obtained, since it is possible to apply the film to multiple supports simultaneously.

This invention brings important advantages.

In fact, thanks to this invention it has been possible to provide an apparatus for application of a film to a support which allows an increase in productivity and a reduction in production costs compared with prior art apparatuses.

In particular, thanks to this invention it has been possible to provide an apparatus which enjoys benefits typical of conveyors with linear motors as regards the movement of the supports, without being affected by the disadvantages of this type of conveyors currently known.

Finally, it should be noticed that this invention is relatively easy to produce and that even the cost linked to implementing the invention is not very high. The invention described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. An apparatus for application of a film to a support, where the support is configured to constitute a part of a pack for packaging a product, said apparatus comprising:

a movement path with which an application station is associated;

a movement element, which is movable along the movement path and which, in use, is moved along the movement path;

a supporting element which is coupled to the movement element and which is movable with movement element along the movement path, the supporting element defining at least one housing for housing, in use, the support;

an application device which is associated with the movement path at the application station and which is configured to apply, in use, the film to the support when the supporting element is placed at the application station;

wherein:

the application device comprises the supporting element when the supporting element is placed at the application station, as well as a closing element and a contact element which are configured to associate, in use, with the supporting element placed at the application station;

the supporting element is interposed between the closing element and the contact element when the supporting element is placed at the application station;

when the supporting element is placed at the application station, the closing element and the supporting element are movable, at least one relative to the other, between an opening position, in which the closing element and the supporting element are uncoupled and spaced apart from each other, and a closing position, in which the closing element and the supporting element are coupled to each other to apply, in use, the film to the support;

the contact element provides a contact for the supporting element and supports the supporting element when the closing element and the supporting element are in the closing position; and the contact element is fixed and stationary relative to the movement path and the closing element is movable relative to the movement path.

2. The apparatus according to claim 1, wherein the supporting element is movable relative to the movement element between a non-operating position and an operating position, the supporting element being in the non-operating position when the closing element and the supporting element are in the opening position, and the supporting element being in the operating position when the closing element and the supporting element are in the closing position.

3. The apparatus according to claim 2, wherein the movement of the supporting element between the non-operating position and the operating position is caused:

by a movement of the closing element and/or of the contact element; and/or by the interaction of the supporting element with the closing element and/or with the contact element.

4. The apparatus according to claim 2, also comprising an elastic element which is mounted between the supporting element and the movement element, and which is elastically switchable between a first configuration and a second configuration, the elastic element being in the first configuration when the supporting element is in the non-operating position and being in the second configuration when the supporting element is in the operating position, the movement of the supporting element between the non-operating position and the operating position causing the elastic switching of the elastic element respectively between the first configuration and the second configuration.

5. The apparatus according to claim 4, wherein, during the movement from the opening position to the closing position, the closing element and the supporting element assume an intermediate position, in which the closing element and the supporting element are coupled to each other and the supporting element is spaced apart from the contact element, and wherein:

during the movement from the opening position to the intermediate position, the supporting element remains stationary relative to the movement element and the closing element moves towards the supporting element; and during the movement from the intermediate position to the closing position, the closing element and the supporting element move together with each other as one, the supporting element being moved by the closing element towards the movement element; and during the movement from the intermediate position to the closing position, the elastic element elastically switches its configuration from the first configuration to the second configuration.

6. The apparatus according to claim 4, wherein, when the closing element and the supporting element are in the closing position, the supporting element is clamped between the closing element and the contact element and the elastic element is in the second configuration.

7. The apparatus according to claim 4, wherein, during the movement of the contact element from the home position to the working position, the contact element assumes a transit position, in which the contact element and the supporting element are coupled to each other and the supporting element is spaced apart from the closing element, and wherein:

during the movement from the home position to the transit position, the supporting element remains stationary relative to the movement element and the contact element moves towards the supporting element; and during the movement from the transit position to the working position, the contact element and the supporting element move together with each other as one, the supporting element being moved by the contact element away from the movement element; and during the movement from the transit position to the working position, the elastic element elastically switches its configuration from the first configuration to the second configuration.

8. The apparatus according to claim 1, wherein, during the movement from the opening position to the closing position, the closing element and the supporting element assume an intermediate position, in which the closing element and the supporting element are coupled to each other and the supporting element is spaced apart from the contact element, and wherein:

during the movement from the opening position to the intermediate position, the supporting element remains stationary relative to the movement element and the closing element moves towards the supporting element; and during the movement from the intermediate position to the closing position, the closing element and the supporting element move together with each other as one, the supporting element being moved by the closing element towards the movement element.

9. The apparatus according to claim 1, wherein, when the closing element and the supporting element are in the opening position, the supporting element is in contact with the contact element.

10. The apparatus according to claim 1, wherein the contact element is movable relative to the movement path, between a home position and a working position in which the contact element provides a contact for the supporting element and supports the supporting element when the closing element and the supporting element are in the closing position.

11. The apparatus according to claim 10, wherein, during the movement of the contact element from the home position to the working position, the contact element assumes a transit position, in which the contact element and the supporting element are coupled to each other and the supporting element is spaced apart from the closing element, and wherein:

during the movement from the home position to the transit position, the supporting element remains stationary relative to the movement element and the contact element moves towards the supporting element; and during the movement from the transit position to the working position, the contact element and the supporting element move together with each other as one, the supporting element being moved by the contact element away from the movement element.

12. The apparatus according to claim 1, wherein, when the closing element and the supporting element are in the closing position, the closing element and the supporting element jointly delimit an application chamber and are coupled to each other in a fluid-tight manner relative to the outside.

13. The apparatus according to claim 12, wherein:

made in the supporting element there is a plurality of first ducts, the first ducts of said plurality being in fluid communication with the housing;

made in the contact element there is a plurality of second ducts, which are connected respectively to a suction device and/or to an intake device;

wherein, when the supporting element is coupled to the contact element:

the first ducts of said plurality are in fluid communication with the second ducts of said plurality; and respectively, said suction device is connected to the application chamber to suck air from the application chamber, and/or said intake device is connected to the application chamber to take gas into the application chamber.

14. The apparatus according to claim 13, wherein the contact element comprises:

a first member which is fixed and stationary relative to the movement path and in which a first group of second ducts of said plurality is made; and a second member which is removably coupled to the first member, which is interposed between the first member and the closing element and in which a second group of second ducts of said plurality is made;

wherein, the first group of second ducts of said plurality is in fluid communication with the second group of second ducts of said plurality and is connected respectively to the suction device and/or to the intake device, the first group of second ducts of said plurality being interposed between the second group of second ducts of said plurality and the suction device and/or the intake device, and wherein, when the supporting element and the contact element are coupled to each other, the second group of second ducts of said plurality is in fluid communication with the plurality of first ducts.

15. The apparatus according to claim 14, comprising:

a supporting element of a first type and a second member of a first type, the second member of the first type being configured to couple to the supporting element of the first type; and a supporting element of a second type and a second member of a second type, the second member of the second type being configured to couple to the supporting element of the second type;

wherein:

the supporting element of the first type and the supporting element of the second type are interchangeably mountable on the same movement element;

the second ducts of the second group of second ducts of said plurality made in the second member of the first type extend in such a way as to couple to the second ducts of the first group of second ducts of said plurality made in the first member, and to the first ducts of said plurality made in the supporting element of the first type;

the second ducts of the second group of second ducts of said plurality made in the second member of the second type extend in such a way as to couple to the second ducts of the first group of second ducts of said plurality made in the first member, and to the first ducts of said plurality made in the supporting element of the second type; and the second member of the first type and the second member of the second type are removably couplable to the first member in such a way as to be interchangeable with each other.

16. The apparatus according to claim 12, wherein:

made in the supporting element there is a plurality of first ducts, the first ducts of said plurality being in fluid communication with the housing;

made in the closing element there is a plurality of third ducts, which are connected respectively to a suction device and/or to an intake device;

wherein, when the supporting element and the closing element are in the closing position:

the first ducts of said plurality are in fluid communication with the third ducts of said plurality; and respectively, said suction device is connected to the application chamber to suck air from the application chamber, and/or said intake device is connected to the application chamber to take gas into the application chamber.

17. The apparatus according to claim 1, comprising:

a plurality of movement elements which are movable one after another along the movement path and which are moved, in use, along the movement path; and a plurality of supporting elements, each of which is coupled to a movement element of said plurality and is movable with said movement element of said plurality along the movement path, each supporting element of said plurality defining at least one housing for housing, in use, a support;

wherein:

the application device comprises said supporting elements when said supporting elements are placed at the application station, as well as a closing element for each supporting element placed in the application station, said closing element being configured to associate, in use, with a supporting element placed at the application station; and the supporting elements of said plurality are interposed between the closing elements and the contact element when those supporting elements are placed at the application station.

18. The apparatus according to claim 1, comprising two contact elements placed at the application station, a first contact element, placed at a first side of the movement path, and a second contact element, placed at a second side of the movement path opposite to the first side.

19. The apparatus according to claim 1, wherein the supporting element defines a plurality of housings each of which is configured to receive a different support.

20. The apparatus according to claim 1, also comprising positioning means for the film which are configured to position, in use, the film in the application device, above the support, between the closing element and the supporting element, when the supporting element is in the application station.

21. The apparatus according to claim 1, wherein the application device is selected from a group comprising:

a modified atmosphere sealing machine;

a vacuum sealing machine;

a skin packaging machine;

a closing machine; and a thermoforming machine configured to apply, in use, the film to the support by thermoforming of the film on the support.

22. The apparatus according to claim 1, wherein the apparatus also comprises a guide which is constituted of a guide with linear motors or with planar motor and which defines the movement path, and wherein the movement element is slidably associated with the guide and, in use, is moved along the movement path by the linear motors or by the planar motor of the guide.

23. An apparatus for application of a film to a support, where the support is configured to constitute a part of a pack for packaging a product, said apparatus comprising:

a movement path with which an application station is associated;

a movement element, which is movable along the movement path and which, in use, is moved along the movement path;

a supporting element which is coupled to the movement element and which is movable with movement element along the movement path, the supporting element defining at least one housing for housing, in use, the support;

an application device which is associated with the movement path at the application station and which is configured to apply, in use, the film to the support when the supporting element is placed at the application station;

wherein:

the application device comprises the supporting element when the supporting element is placed at the application station, as well as a closing element and a contact element which are configured to associate, in use, with the supporting element placed at the application station;

the supporting element is interposed between the closing element and the contact element when the supporting element is placed at the application station;

when the supporting element is placed at the application station, the closing element and the supporting element are movable, at least one relative to the other, between an opening position, in which the closing element and the supporting element are uncoupled and spaced apart from each other, and a closing position, in which the closing element and the supporting element are coupled to each other to apply, in use, the film to the support;

the contact element provides a contact for the supporting element and supports the supporting element when the closing element and the supporting element are in the closing position; and the supporting element is movable relative to the movement element between a non-operating position and an operating position, the supporting element being in the non-operating position when the closing element and the supporting element are in the opening position, and the supporting element being in the operating position when the closing element and the supporting element are in the closing position;

the apparatus further comprising an elastic element which is mounted between the supporting element and the movement element for coupling the supporting element and the movement element, and which is elastically switchable between a first configuration and a second configuration, the elastic element being in the first configuration when the supporting element is in the non-operating position and being in the second configuration when the supporting element is in the operating position, the movement of the supporting element between the non-operating position and the operating position causing the elastic switching of the elastic element respectively between the first configuration and the second configuration.

24. The apparatus according to claim 23, wherein, during the movement from the opening position to the closing position, the closing element and the supporting element assume an intermediate position, in which the closing element and the supporting element are coupled to each other and the supporting element is spaced apart from the contact element, and wherein:

during the movement from the opening position to the intermediate position, the supporting element remains stationary relative to the movement element and the closing element moves towards the supporting element; and during the movement from the intermediate position to the closing position, the closing element and the supporting element move together with each other as one, the supporting element being moved by the closing element towards the movement element; and during the movement from the intermediate position to the closing position, the elastic element elastically switches its configuration from the first configuration to the second configuration.

25. An apparatus for application of a film to a support, where the support is configured to constitute a part of a pack for packaging a product, said apparatus comprising:

a movement path with which an application station is associated;

a movement element, which is movable along the movement path and which, in use, is moved along the movement path;

a supporting element which is coupled to the movement element and which is movable with movement element along the movement path, the supporting element defining at least one housing for housing, in use, the support;

an application device which is associated with the movement path at the application station and which is configured to apply, in use, the film to the support when the supporting element is placed at the application station;

wherein:

the application device comprises the supporting element when the supporting element is placed at the application station, as well as a closing element and a contact element which are configured to associate, in use, with the supporting element placed at the application station;

the supporting element is interposed between the closing element and the contact element when the supporting element is placed at the application station;

when the supporting element is placed at the application station, the closing element and the supporting element are movable, at least one relative to the other, between an opening position, in which the closing element and the supporting element are uncoupled and spaced apart from each other, and a closing position, in which the closing element and the supporting element are coupled to each other to apply, in use, the film to the support;

the contact element provides a contact for the supporting element and supports the supporting element when the closing element and the supporting element are in the closing position;

when the closing element and the supporting element are in the closing position, the closing element and the supporting element jointly delimit an application chamber and are coupled to each other in a fluid-tight manner relative to the outside;

made in the supporting element there is a plurality of first ducts, the first ducts of said plurality being in fluid communication with the housing;

made in the contact element there is a plurality of second ducts, which are connected respectively to a suction device and/or to an intake device;

wherein, when the supporting element is coupled to the contact element:

the first ducts of said plurality are in fluid communication with the second ducts of said plurality; and respectively, said suction device is connected to the application chamber to suck air from the application chamber, and/or said intake device is connected to the application chamber to take gas into the application chamber.

26. The apparatus according to claim 25, wherein the contact element comprises:

a first member which is fixed and stationary relative to the movement path and in which a first group of second ducts of said plurality is made; and a second member which is removably coupled to the first member, which is interposed between the first member and the closing element and in which a second group of second ducts of said plurality is made;

wherein, the first group of second ducts of said plurality is in fluid communication with the second group of second ducts of said plurality and is connected respectively to the suction device and/or to the intake device, the first group of second ducts of said plurality being interposed between the second group of second ducts of said plurality and the suction device and/or the intake device, and wherein, when the supporting element and the contact element are coupled to each other, the second group of second ducts of said plurality is in fluid communication with the plurality of first ducts.

27. An apparatus for application of a film to a support, where the support is configured to constitute a part of a pack for packaging a product, said apparatus comprising:

a movement path with which an application station is associated;

a movement element, which is movable along the movement path and which, in use, is moved along the movement path;

a supporting element which is coupled to the movement element and which is movable with movement element along the movement path, the supporting element defining at least one housing for housing, in use, the support;

an application device which is associated with the movement path at the application station and which is configured to apply, in use, the film to the support when the supporting element is placed at the application station;

wherein:

the application device comprises the supporting element when the supporting element is placed at the application station, as well as a closing element and a contact element which are configured to associate, in use, with the supporting element placed at the application station;

the supporting element is interposed between the closing element and the contact element when the supporting element is placed at the application station;

when the supporting element is placed at the application station, the closing element and the supporting element are movable, at least one relative to the other, between an opening position, in which the closing element and the supporting element are uncoupled and spaced apart from each other, and a closing position, in which the closing element and the supporting element are coupled to each other to apply, in use, the film to the support;

the contact element provides a contact for the supporting element and supports the supporting element when the closing element and the supporting element are in the closing position;

when the closing element and the supporting element are in the closing position, the closing element and the supporting element jointly delimit an application chamber and are coupled to each other in a fluid-tight manner relative to the outside;

made in the supporting element there is a plurality of first ducts extending from starting ends to final ends, the first ducts of said plurality being in fluid communication with the housing through their final ends which define openings at an inner surface of the supporting element;

made in the closing element there is a plurality of third ducts, which are connected respectively to a suction device and/or to an intake device;

wherein, when the supporting element and the closing element are in the closing position:

the starting ends of the first ducts of said plurality are connected and in fluid communication with the third ducts of said plurality so that respectively, said suction device and/or said intake device is connected to the application chamber through the third ducts and the first ducts connected to each other, to, respectively, suck air from the application chamber, and/or take gas into the application chamber.

* * * * *